US007753063B1

(12) United States Patent
Laws

(10) Patent No.: US 7,753,063 B1
(45) Date of Patent: Jul. 13, 2010

(54) ATTACHABLE/DETACHABLE SUN SHADE APPARATUS

(76) Inventor: John E. Laws, 6658 Keeneland Way, Mason, OH (US) 45040

( * ) Notice: Subject to any disclaimer, the term of this patent is extended or adjusted under 35 U.S.C. 154(b) by 0 days.

(21) Appl. No.: 12/336,599

(22) Filed: Dec. 17, 2008

Related U.S. Application Data

(60) Provisional application No. 61/014,775, filed on Dec. 19, 2007.

(51) Int. Cl.
*E04H 15/02* (2006.01)

(52) U.S. Cl. ..... 135/96; 135/90; 135/117; 297/184.15

(58) Field of Classification Search ..... 135/90, 135/96, 117, 155, 88.04, 143; 297/184.1, 297/184.11, 184.15, 184.17; 280/647, 650
See application file for complete search history.

(56) References Cited

U.S. PATENT DOCUMENTS

| | | | | |
|---|---|---|---|---|
| 3,738,703 | A | 6/1973 | Kunimatu | |
| 3,840,161 | A | 10/1974 | Boggs | |
| 4,112,957 | A * | 9/1978 | Biven | 135/87 |
| 4,561,622 | A * | 12/1985 | Heinzel | 248/439 |
| 5,000,210 | A | 3/1991 | Worthington | |
| 5,135,281 | A | 8/1992 | Pappalardo | |
| 5,203,363 | A | 4/1993 | Kidwell | |
| 5,695,100 | A | 12/1997 | O'Brien | |
| 5,797,650 | A | 8/1998 | Gonzalez | |
| 5,951,103 | A * | 9/1999 | Barnhill | 297/248 |
| 5,967,601 | A | 10/1999 | Gillins | |
| 6,199,819 | B1 * | 3/2001 | Churillo | 248/540 |
| 6,244,286 | B1 | 6/2001 | Russo | |
| 6,371,553 | B1 | 4/2002 | Tang | |
| 6,435,469 | B1 * | 8/2002 | Ratcliff et al. | 248/535 |
| 6,471,289 | B2 * | 10/2002 | Aguilar | 297/184.16 |
| 6,789,557 | B1 | 9/2004 | Wahl | |
| 7,243,990 | B1 | 7/2007 | Wahl | |
| 7,374,238 | B2 * | 5/2008 | Lingwall | 297/184.11 |
| 7,431,389 | B2 * | 10/2008 | Reeb et al. | 297/184.15 |
| 7,585,020 | B1 * | 9/2009 | Wahl, Jr. | 297/184.15 |
| 2006/0054207 | A1 | 3/2006 | Wootliff | |
| 2007/0018486 | A1 | 1/2007 | Ayers | |
| 2007/0040422 | A1 | 2/2007 | Reeb | |

FOREIGN PATENT DOCUMENTS

| | | | |
|---|---|---|---|
| AU | 9215170 | A | 12/1993 |
| DE | 20021516 | U1 | 5/2001 |
| GB | 2 406 311 | A | 3/2005 |
| JP | 2000316660 | A | 11/2000 |

* cited by examiner

*Primary Examiner*—Winnie Yip
(74) *Attorney, Agent, or Firm*—Frederick H. Gribbell

(57) ABSTRACT

The present invention relates generally to portable sun shades, and more particularly to those that are attachable to portable chairs. The sun shade invention includes a set of chair connectors that are "press fit" onto a frame member of a portable chair, and the chair connectors mechanically support the weight of the sun shade so that it maintains its position on the chair, without any other fasteners or locking hardware. The sun shade also includes a flexible support member along each side of its overall frame structure, which allows the sun shade to be positioned at various angles with respect to the horizontal plane. The sun shade further includes an adjustable width capability so that it can be mounted onto different models of portable chairs, of different widths.

20 Claims, 33 Drawing Sheets

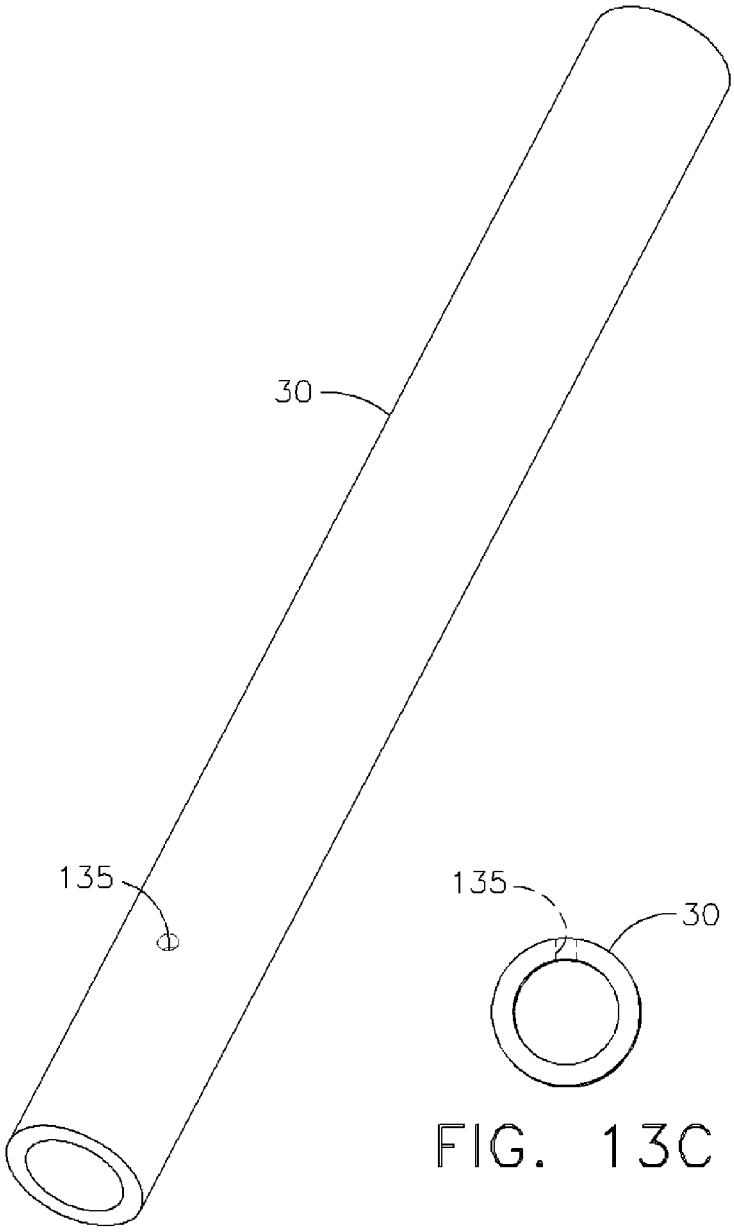
FIG. 13A
FIG. 13C
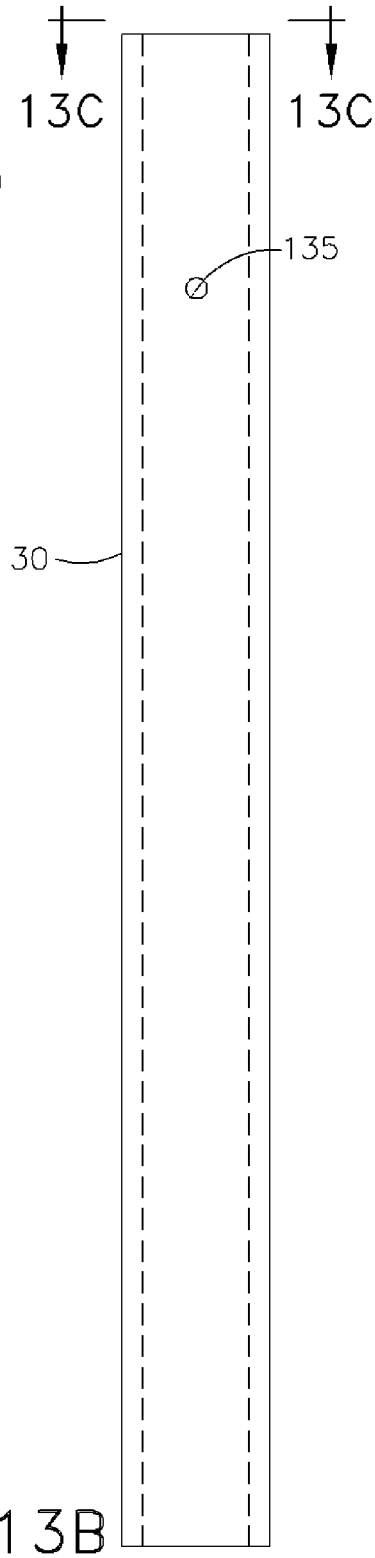
FIG. 13B

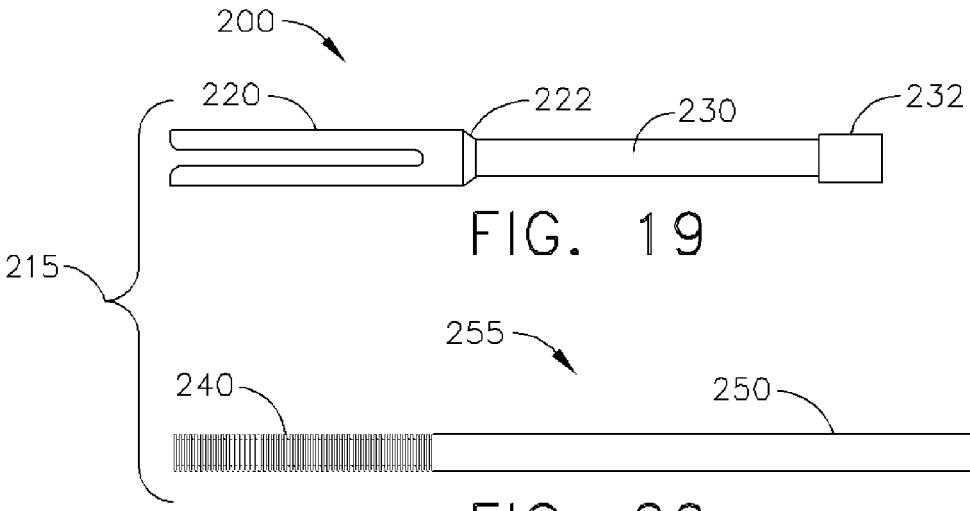
FIG. 19
FIG. 20
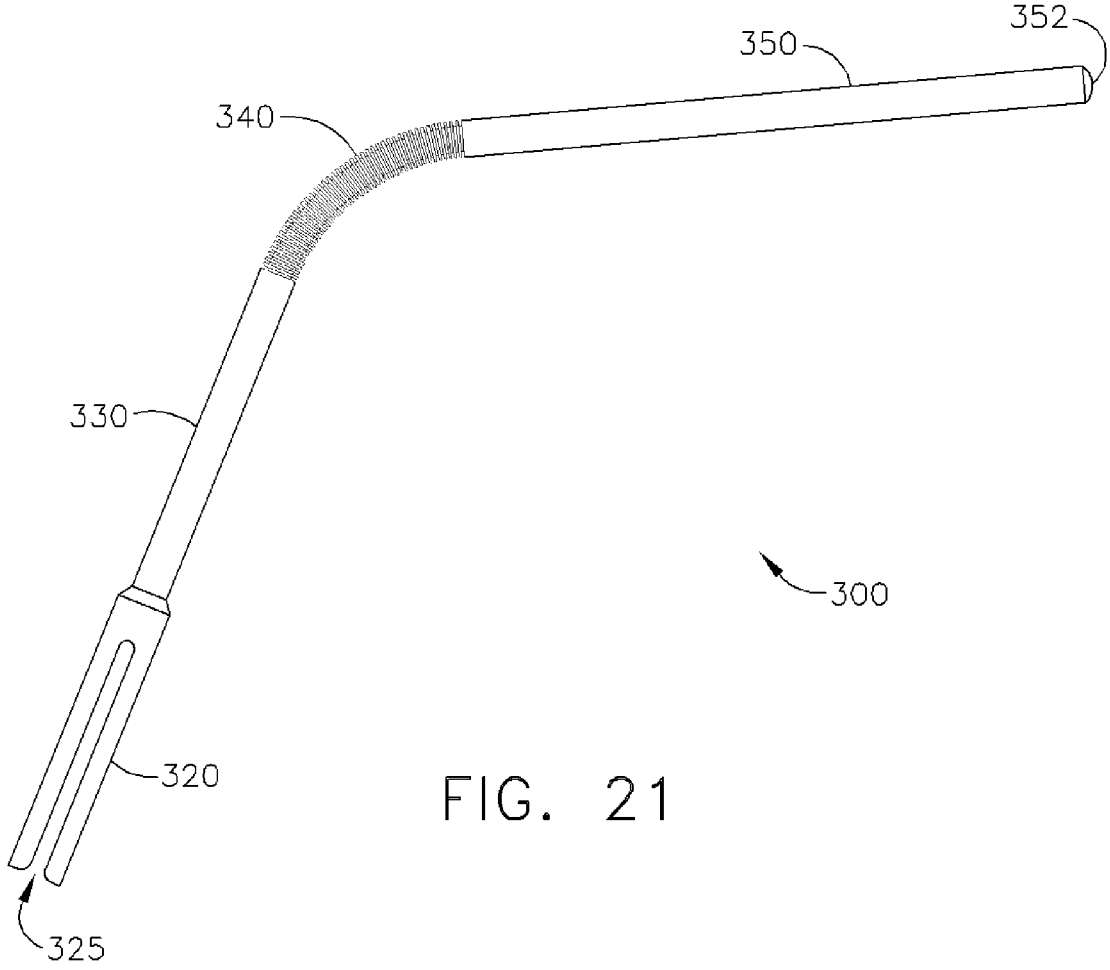
FIG. 21

ATTACHABLE/DETACHABLE SUN SHADE APPARATUS

CROSS-REFERENCE TO RELATED APPLICATIONS

This is a non-provisional application based upon U.S. provisional patent application Ser. No. 61/014,775, titled "ATTACHABLE/DETACHABLE SUN SHADE APPARATUS", filed on Dec. 19, 2007.

BACKGROUND OF THE INVENTION

1. Field of the Invention

The present invention relates generally to portable sun shades, and more particularly to those that are attachable to portable chairs. The sun shade invention includes a set of chair connectors that are "press fit" onto a frame member of a portable chair, and the chair connectors mechanically support the weight of the sun shade so that it maintains its position on the chair, without any other fasteners or locking hardware. The sun shade also includes a flexible support member, or a variable-angle spring, along each side of its overall frame structure, which allows the sun shade to be positioned at various angles with respect to the horizontal plane. The sun shade further includes an adjustable width capability so that it can be mounted onto different models of portable chairs, of different widths.

2. Description of the Related Art

Conventional portable sun shades have been available that can be attached to portable chairs. Most of the conventional sun shades use some type of C-clamp or U-clamp to attach to the framework of a chair backrest. Several of other conventional sun shades use some type of hook and loop fasteners (e.g., VELCRO), or some other type of fastener. These conventional sun shades each use, in essence, some type of locking/unlocking hardware (e.g., fasteners, or variable placement devices that can change the distance at which they fasten, or "lock" into position) that allows them to be placed onto a portable chair, and then to maintain that placement.

What is needed in the art is a portable sun shade that can be quickly "clipped" or pressed onto a portable chair, yet will be supported once in position so that it will remain in its proper position on the chair.

SUMMARY OF THE INVENTION

Accordingly, it is an advantage of the present invention to provide a sun shade that has a press fit chair connector that can be easily placed onto the upper rear framework of a portable chair, such as a foldable canvas chair.

It is another advantage of the present invention to provide a sun shade that mounts to a portable chair, in which the sun shade has a support frame structure which includes a flexible support member that allows the angular configuration between the chair connector and the far end support member to be varied, without use of "hold-down" fasteners or locking/unlocking hardware.

It is a further advantage of the present invention to provide a sun shade that mounts to a portable chair, in which the framework of the sun shade can be adjusted for different widths of the portable chair, without the need for additional mounting hardware or adjusting/locking hardware that provides the variable width capability.

It is yet another advantage of the present invention to provide a sun shade that mounts to a portable chair, in which the sun shade has a support frame structure which includes a torsion spring member that allows the angular configuration between the chair connector and the far end support member to be varied, without use of "hold-down" fasteners or locking/unlocking hardware.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, support frame apparatus for a sun shade is provided, which comprises: (a) a first frame-half sub-assembly, comprising: a first elongated support member extending between a first end and a second end along a first longitudinal axis; a first elongated press fit chair connector member extending between a third end and a fourth end along a second longitudinal axis; a first variable angle member that is in mechanical communication with the second end of the first elongated support member and that is in mechanical communication with the third end of the first elongated press fit chair connector member; (b) a second frame-half sub-assembly, comprising: a second elongated support member extending between a fifth end and a sixth end along a third longitudinal axis; a second elongated press fit chair connector member extending between a seventh end and an eighth end along a fourth longitudinal axis; a second variable angle member that is in mechanical communication with the sixth end of the second elongated support member and that is in mechanical communication with the seventh end of the second elongated press fit chair connector member; and (c) at least one cross-frame member that is in mechanical communication with the first elongated support member and with the second elongated support member and, in one configuration, which tends to hold the first and second elongated support members in a spaced-apart relationship; wherein: the first and second press fit chair connector members each are capable of being press fit to, and then maintain their positions on, an external object without the use of locking/unlocking hardware; and the first and second press fit chair connector members are spaced-apart from one another, and at their fourth and eighth ends are capable of being moved to a plurality of different positions, each having a varying distance from one another, without the use of locking/unlocking hardware.

In accordance with another aspect of the present invention, support frame apparatus for a sun shade is provided, which comprises: (a) a first frame-half sub-assembly, comprising: a first elongated support member extending between a first end and a second end along a first longitudinal axis; a first elongated press fit chair connector member extending between a third end and a fourth end along a second longitudinal axis; a first variable angle member that is in mechanical communication with the second end of the first elongated support member and that is in mechanical communication with the third end of the first elongated press fit chair connector member; (b) a second frame-half sub-assembly, comprising: a second elongated support member extending between a fifth end and a sixth end along a third longitudinal axis; a second elongated press fit chair connector member extending between a seventh end and an eighth end along a fourth longitudinal axis; a second variable angle member that is in mechanical communication with the sixth end of the second elongated support member and that is in mechanical communication with the seventh end of the second elongated press fit chair connector member; and (c) at least one cross-frame member that is in mechanical communication with the first elongated support member and with the second elongated support member and, in one configuration, which tends to hold the first and second elongated support members in a spaced-apart relationship; wherein: the first variable angle member allows a first angle between the first longitudinal axis and the second longitudinal axis to be varied by a human user, without the use of additional fasteners, while maintaining structural mechanical communication between the first elongated support member and the first variable angle member, and while maintaining structural mechanical communication between the first variable angle member and the first elongated press fit chair connector member; the second variable angle member allows a second angle between the third longitudinal axis and the fourth longitudinal axis to be varied by a human user, without the use of additional fasteners, while maintaining structural mechanical communication between the second elongated support member and the second variable angle member, and while maintaining structural mechanical communication between the second variable angle member and the second elongated press fit chair connector member; and the first and second elongated press fit chair connector members each are capable of being affixed to an external object.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The above-mentioned and other features and advantages of this invention, and the manner of attaining them, will become more apparent and the invention will be better understood by reference to the following description of at least one embodiment of the invention taken in conjunction with the accompanying drawings. The accompanying drawings incorporated in and forming a part of the specification illustrate several aspects of the present invention, and together with the description and claims serve to explain the principles of the invention. In the drawings:

FIGS. 13A-13C are three views of a first longitudinal support member that is used in the sun shade of FIG. 1.

FIG. 19 is a side view of a first alternative embodiment of a first portion of the framework sub-assembly for the sun shade of FIG. 1.

FIG. 20 is a side view of the first alternative embodiment of a second portion of the framework sub-assembly for the sun shade of FIG. 1.

FIG. 21 is a side view of a second alternative embodiment of one-half of the framework sub-assembly for the sun shade of FIG. 1, in which the entire half portion of the framework is made from a single part.

DETAILED DESCRIPTION OF THE INVENTION

Reference will now be made in detail to the present preferred embodiment of the invention, an example of which is illustrated in the accompanying drawings, wherein like numerals indicate the same elements throughout the views. The exemplification(s) set out herein illustrate(s) at least one preferred embodiment of the invention, in at least one form, and such exemplification(s) (is)(are) not to be construed as limiting the scope of the invention in any manner.

The terms "first" and "second" preceding an element name, e.g., first support member, second support member, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Figure 1:
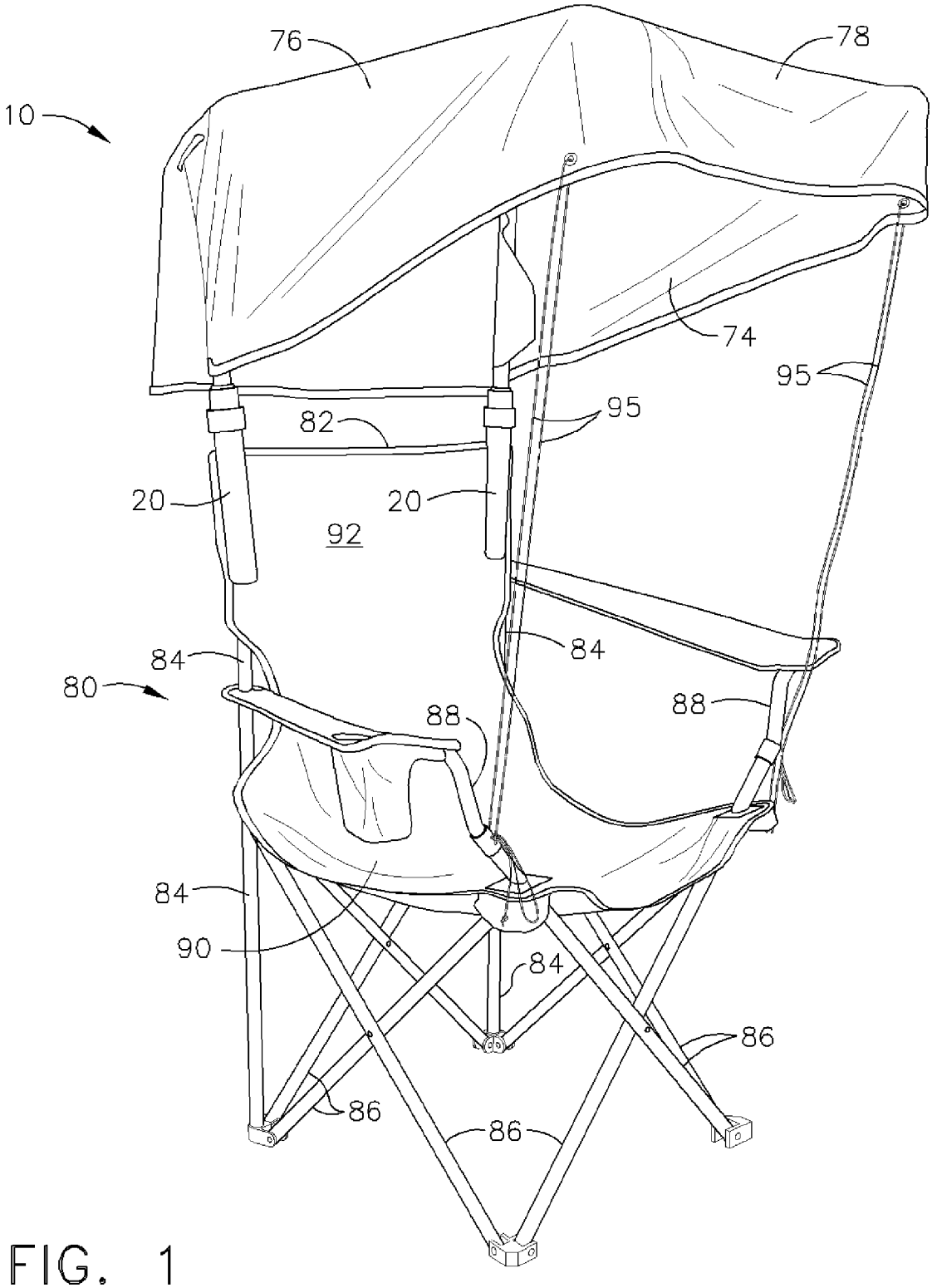
FIG. 1 is a perspective view from the front and right side of a sun shade as it would be mounted to a portable canvas chair, and as constructed according to the principles of the present invention.

Referring now to FIG. 1, the present invention is a sun shade, generally designated by the reference numeral 10, that attaches to a folding canvas chair, which is generally designated by the reference numeral 80. It will be understood that such portable canvas chairs are known in the prior art.

The chair itself includes a top back frame member 82, a pair of upright rear frame members 84 on either side of the top back frame member 82, and all of these frame members are supported by a set of support legs 86. Canvas chair 80 also includes two armrests, which themselves each have a frame member at 88, one on each side of the chair. The canvas chair has a seat portion at 90, and a back support portion at 92. The back support portion is held in place by the upright rear frame members 84 and the top back frame member 82, while the canvas seat portion 90 is supported by various frame members that are in turn supported by the support legs 86.

Figure 3:
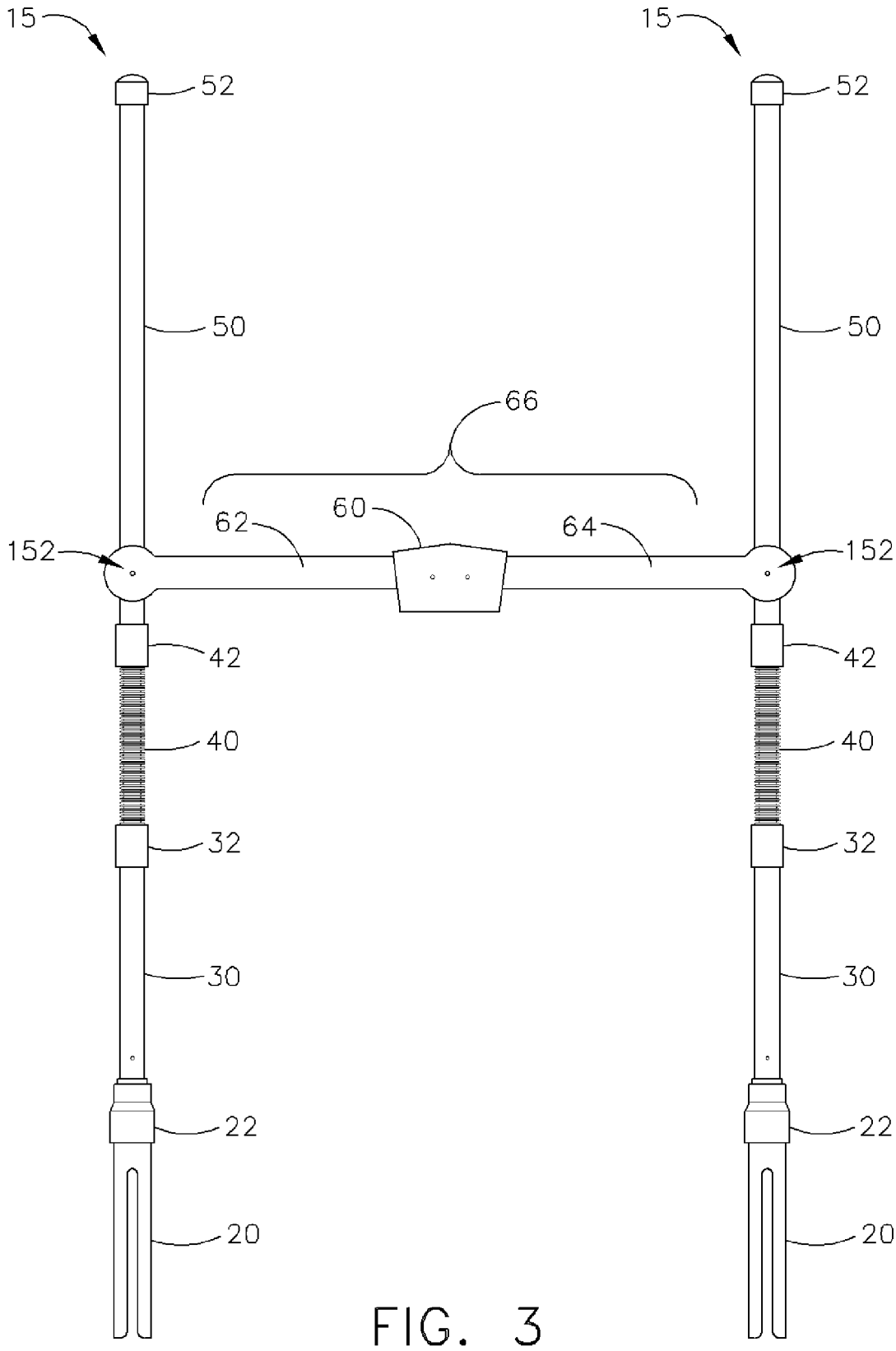
FIG. 3 is an elevational view of the framework sub-assembly of the sun shade of FIG. 1, in which the flexible support members are not bent at an angle, but instead are disposed in a substantially linear manner.
Figure 4:
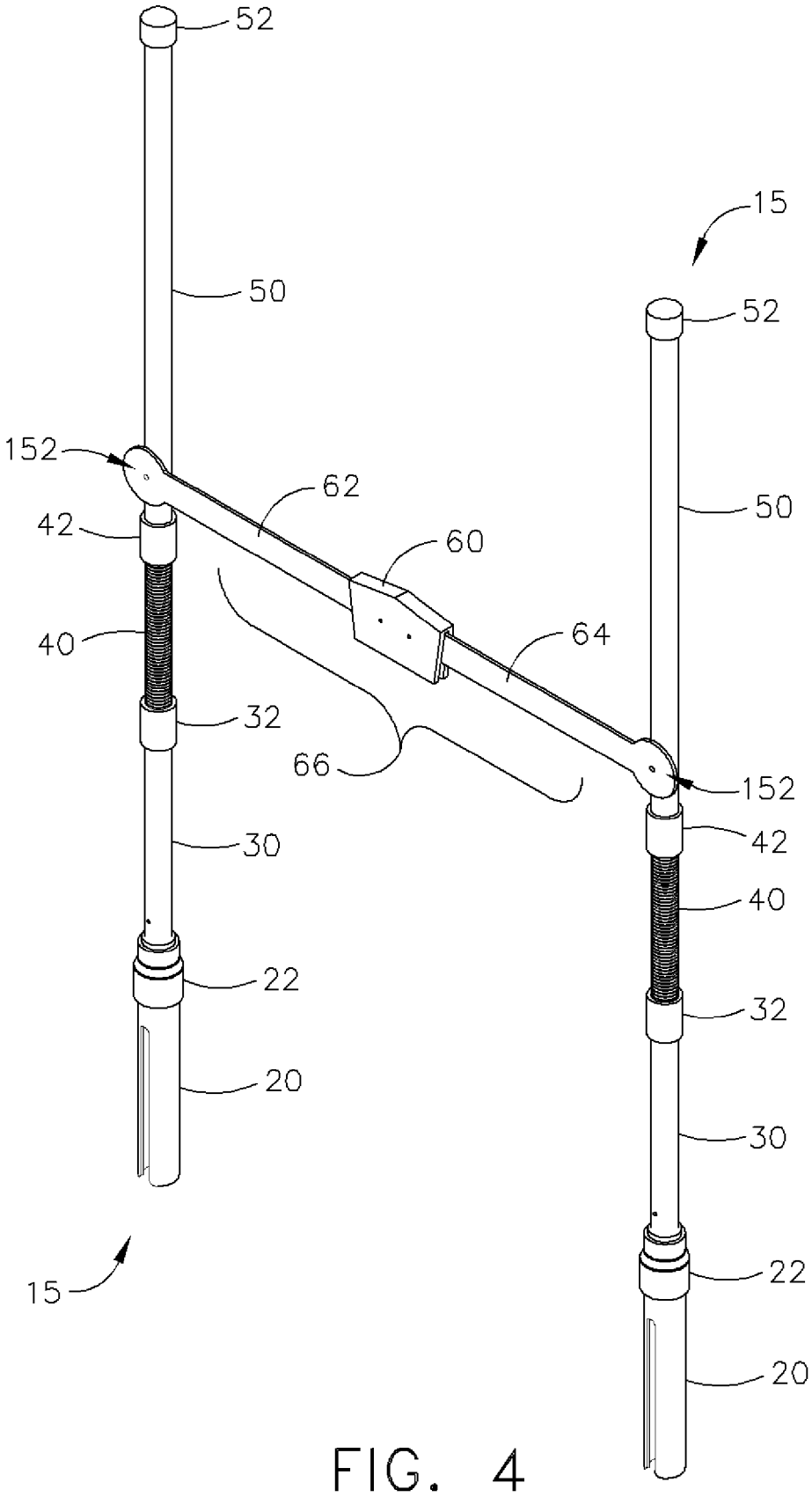
FIG. 4 is a perspective view in partial elevation of the framework sub-assembly of FIG. 3.

The present invention of this first embodiment 10 includes a pair of chair connectors 20, and in this first embodiment, these chair connectors slip over the top back frame 82 and portions of the upright rear frame 84 of the canvas chair 80. The major framework members of the sun shade 10 are illustrated in FIGS. 2-4, and the chair connector 20 itself is illustrated in greater detail in FIGS. 11A-11C.

Figure 2:
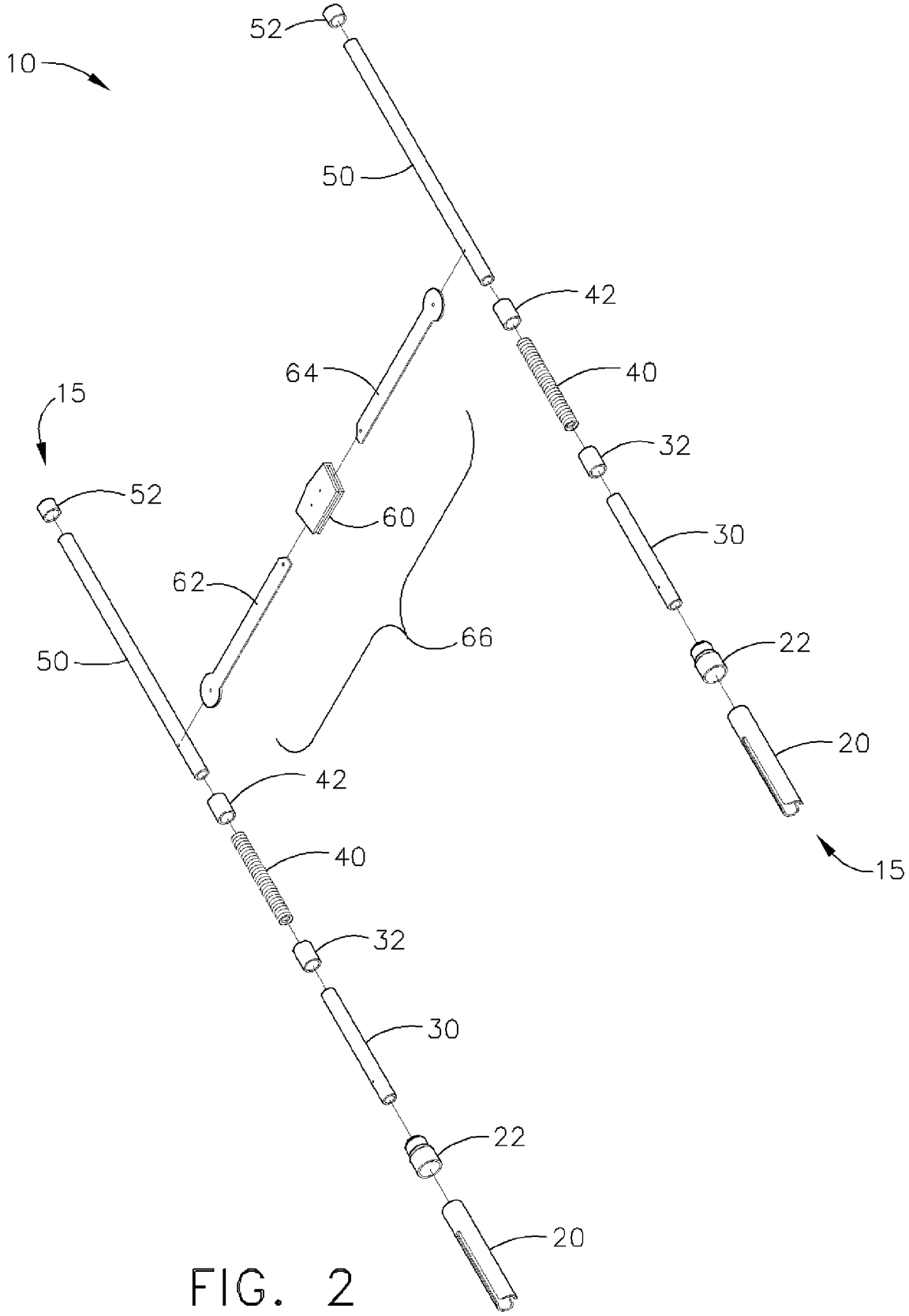
FIG. 2 is an exploded view of the major parts of the framework sub-assembly for the sun shade of FIG. 1.

Referring now to FIG. 2, the major components of the sun shade of the first embodiment are depicted in an exploded view. The two chair connectors 20 are at one end of the assembly, and these are in turn mechanically connected to an adapter 22, which is mechanically connected to a first support member 30. On the opposite end of the first support member 30 is a first coupler 32 which is in mechanical communication with a flexible support member 40. On the opposite end of flexible support member 40 is a second coupler 42. The second coupler 42 is mechanically connected to a second support member 50, and on its opposite end is an end cap 52.

There are two spaced-apart sub-assemblies 15 in the sun shade 10, in which the two sub-assemblies 15 are made up of the components that on one end begin with the chair connector 20 and on the other end finish with the end cap 52. These two sub-assemblies 15 are connected by a pair of "stretcher support arms," which also have a locking member. On FIG. 2, the locking member is pivotable, and is generally designated by the reference numeral 60. A first stretcher support arm is at 62 and a second stretcher support arm is at 64. The combination of these three components 60, 62, and 64 is also referred to herein as a cross-frame sub-assembly 66. The first stretcher support arm 62 is in pivotable communication with one of the second support members 50, and the second stretcher support arm 64 is in pivotable communication with the other second support member 50, as seen in FIG. 2. Both stretcher support arms 62 and 64 are in pivotable mechanical communication with the pivotable locking member 60. This pivotable locking member 60 is illustrated in greater detail in FIGS. 15A-15C. The connections between the second support members 50 and the stretcher support arms 62 and 64 is shown in FIG. 3, which is an assembly view of the components depicted in FIG. 2. FIG. 4 is a perspective view of the same components depicted in FIG. 3.

Figure 22:
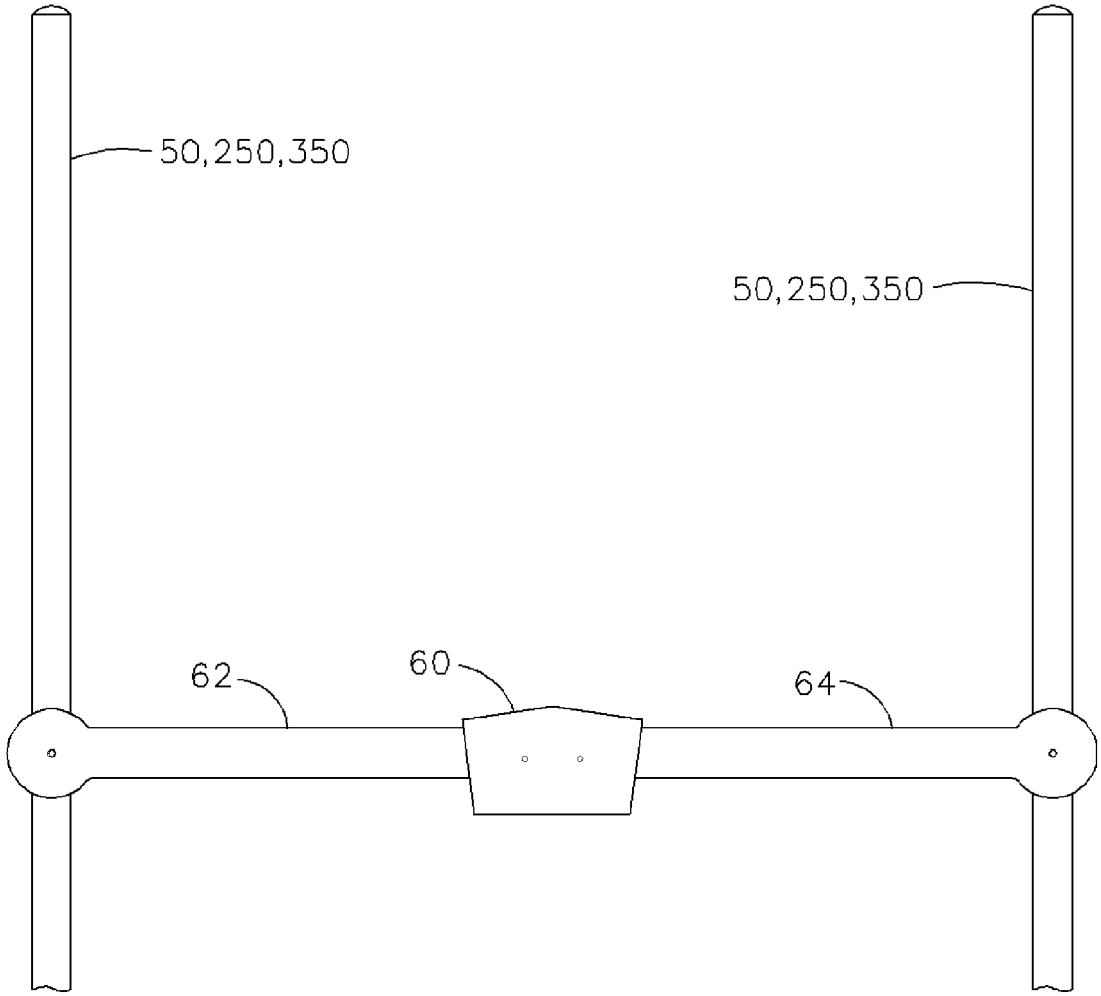
FIG. 22 is an elevational view showing an upper portion of the framework sub-assembly of the sun shade of FIG. 1, in which the stretcher support arms are at their co-linear position that tends to stretch the flexible material covering.
Figure 23:
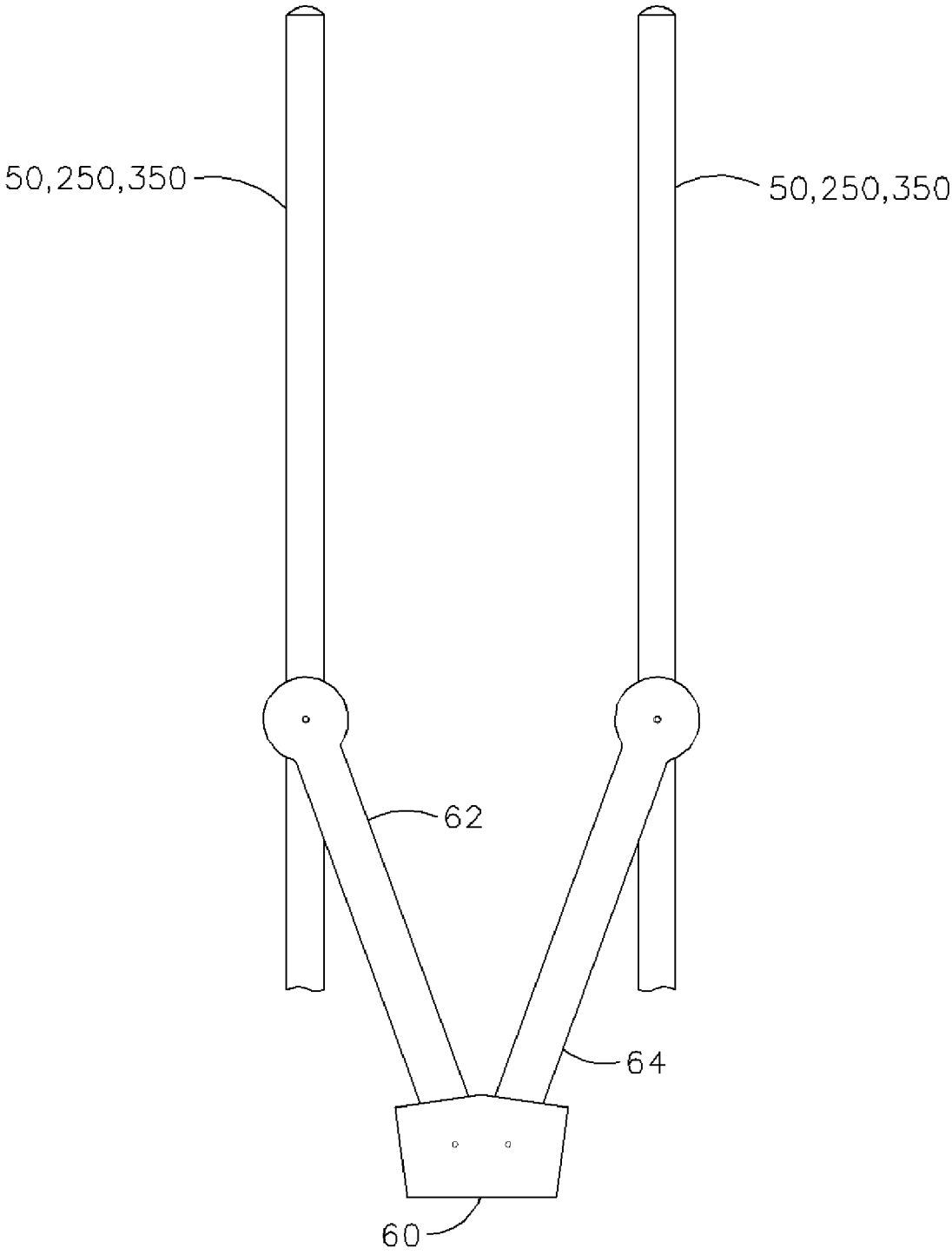
FIG. 23 is an elevational view of the same upper portion as depicted in FIG. 22, in which the stretcher support arms are not in a co-linear position, and would not tend to stretch the flexible material covering.

The pivotable nature of the stretcher support arms 62 and 64 along with the pivotable locking member 60 allow the sun shade 10 to be collapsed into a smaller size for storage and/or for carrying. This is illustrated in FIGS. 22 and 23, in which the first embodiment of the second support members 50 are illustrated as being in their widest spaced-apart configuration in FIG. 22, in which the two stretcher support arms 62 and 64 are co-linear with one another. Alternatively, the stretcher support arms 62 and 64 can be pivoted at the pivotable locking member 60, as depicted in FIG. 23, and in which the second support members 50 of the first embodiment can then be moved much closer together to one another. It will be understood that the configuration depicted in FIG. 23 is not the only angular arrangement other than co-linear for the stretcher support arms 62 and 64, but that the angle between the pivotable locking member 60 and the two stretcher support arms 62 and 64 can infinitely be varied essentially between 0° and 90° as shown on FIG. 23. In other words, the two support members 50 can be moved much closer together than depicted in FIG. 23, or it can be moved to a more spaced-apart position all the way up to the point where the stretcher support arms 62 and 64 are "locked" in position by the pivotable locking member 60, as depicted in FIG. 22. In the "locked" position, the two stretcher support arms 62 and 64 are essentially co-linear with one another; in the fully "collapsed" position (similar to FIG. 23), the two stretcher support arms 62 and 64 are essentially parallel with one another.

Figure 5:
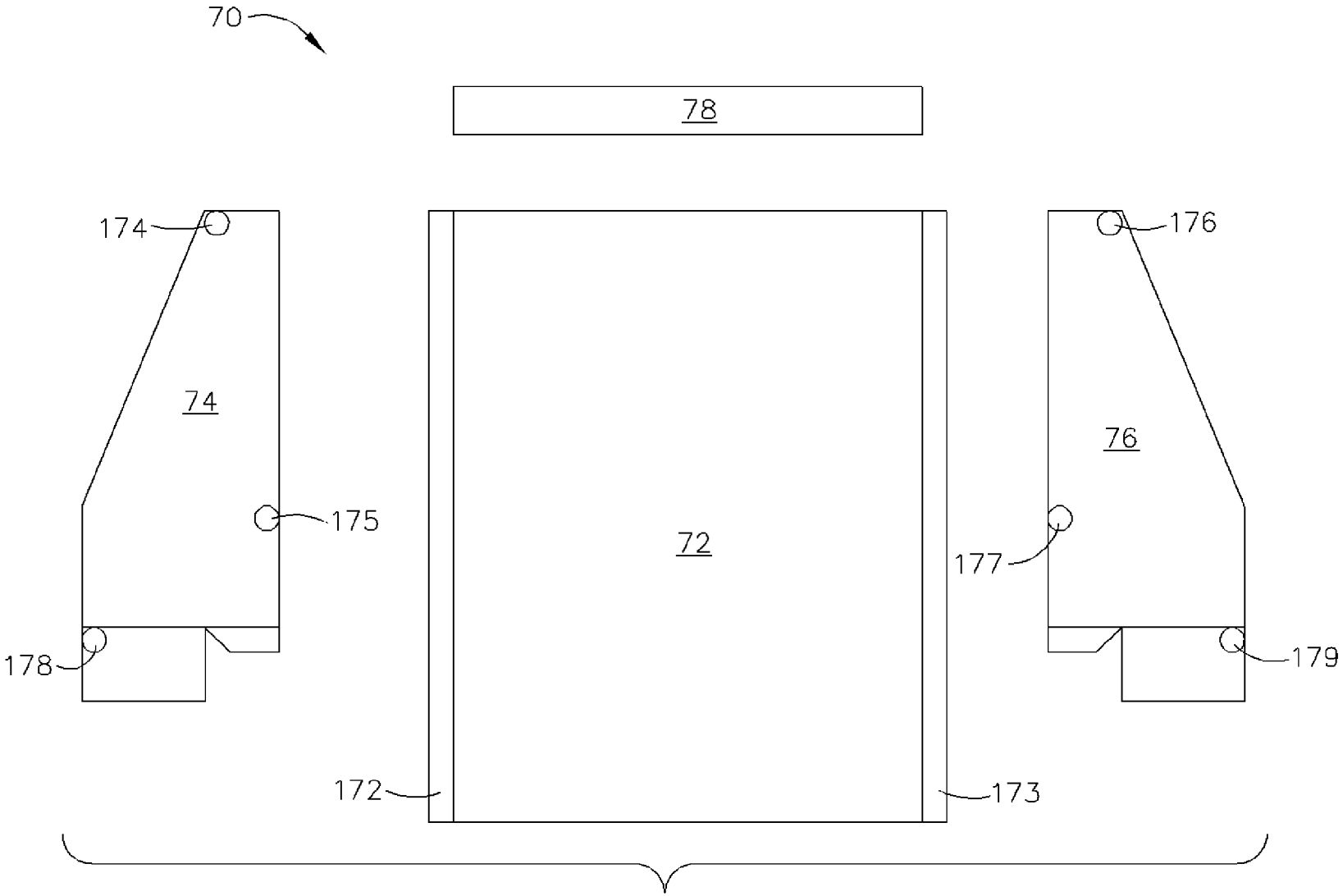
FIG. 5 is a plan view showing the pattern of the flexible material portions that are used in the sun shade of FIG. 1.

Referring now to FIG. 5, a pattern for the flexible material covering is illustrated, in which this covering is initially made up of more than one part, and is generally designated by the reference numeral 70. As can be see in FIG. 1, the covering attaches above and around the sides of certain portions of the framework that was described above and illustrated in FIGS. 2 through 4. In FIG. 1, the covering that is illustrated is at reference numeral 74, 76, and 78. The same portions of material are depicted on FIG. 5.

A large rectangular piece 72 makes up the "top" portion of the covering, and is the largest portion of material depicted in FIG. 5. The rectangular top 72 has two edge panels 172 and 173 that are stitched to the main top portion 72. These edge panels 172 and 173 are actually formed of two layers of material with an opening therebetween, so portions of the frame member can be slid into those openings. Referring to FIG. 2, the second support member 50 on each side of the first embodiment is the member that would be slid into the openings in these edge panels 172 and 173. This will keep the top portion 72 attached to the frame members at the second support member 50.

A "left flap" portion 74 is depicted in FIG. 5, and is to be fastened or otherwise attached to the top member 72 along the edge panel 172. A second flap portion is the "right flap" in FIG. 5, which is depicted by reference numeral 76. This is to be fastened or otherwise attached to the top panel 72 along the other edge panel 173. It will be understood that the left and right flaps 74 and 76, respectively, can be stitched to the top portion 72, or otherwise permanently attached, as desired by the sun shade designer.

The left flap 74 includes a pair of grommets at 174 and 175. The grommet 174 is used to allow some "retainer strings" to be slipped therethrough, and attached to the canvas chair 80, if desired. This can be seen on FIG. 1, in which the retainer strings are designated by the reference numeral 95, and run from the front top portion of the sun shade material down to one of the arm rest frame pieces 88 of the canvas chair 80. This can aid in holding the sun shade in position even on a windy day that might otherwise tend to move the sun shade in an undesirable manner.

It can be seen in FIG. 1 that there is a pair of retainer strings on the left side, and a second pair of retainer strings on the right side of the first embodiment depicted in this view. A different method of attaching retainer strings or other type of elongated "hold down" member could be used without departing from the principles of the present invention.

The left flap 74 also has a heavy duty female snap 178. This can be used to affix the left flap portion of the flexible material to the framework at a male snap 136 (see FIG. 16).

The right flap 76 is attached or otherwise affixed to the top 72 along the edge panel 173. As in the case on the opposite side of the top portion 72, one of the support member frame pieces 50 would slip into an opening between two layers of material at 173. The right flap would then extend down and to the right (as seen in FIG. 5).

Right flap 76 includes a pair of grommets 176 and 177. The grommet 176 is used to allow some "retainer strings" to be slipped therethrough, and attached to the canvas chair 80, if desired. This can be seen on FIG. 1, in which the retainer strings are designated by the reference numeral 95, and run from the front top portion of the sun shade material down to one of the arm rest frame pieces 88 of the canvas chair 80. This can aid in holding the sun shade in position even on a windy day that might otherwise tend to move the sun shade in an undesirable manner.

The grommets 175 and 177 can be used to provide clearance for the fasteners 152 at the pivot points to protrude through the material of the cover panels 74 and 76, respectively. However, these grommets are not necessarily required, and can be replaced by small holes punched in the material of the panels 74 and 76, since this is not a high stress point of the flexible material.

Figure 16:
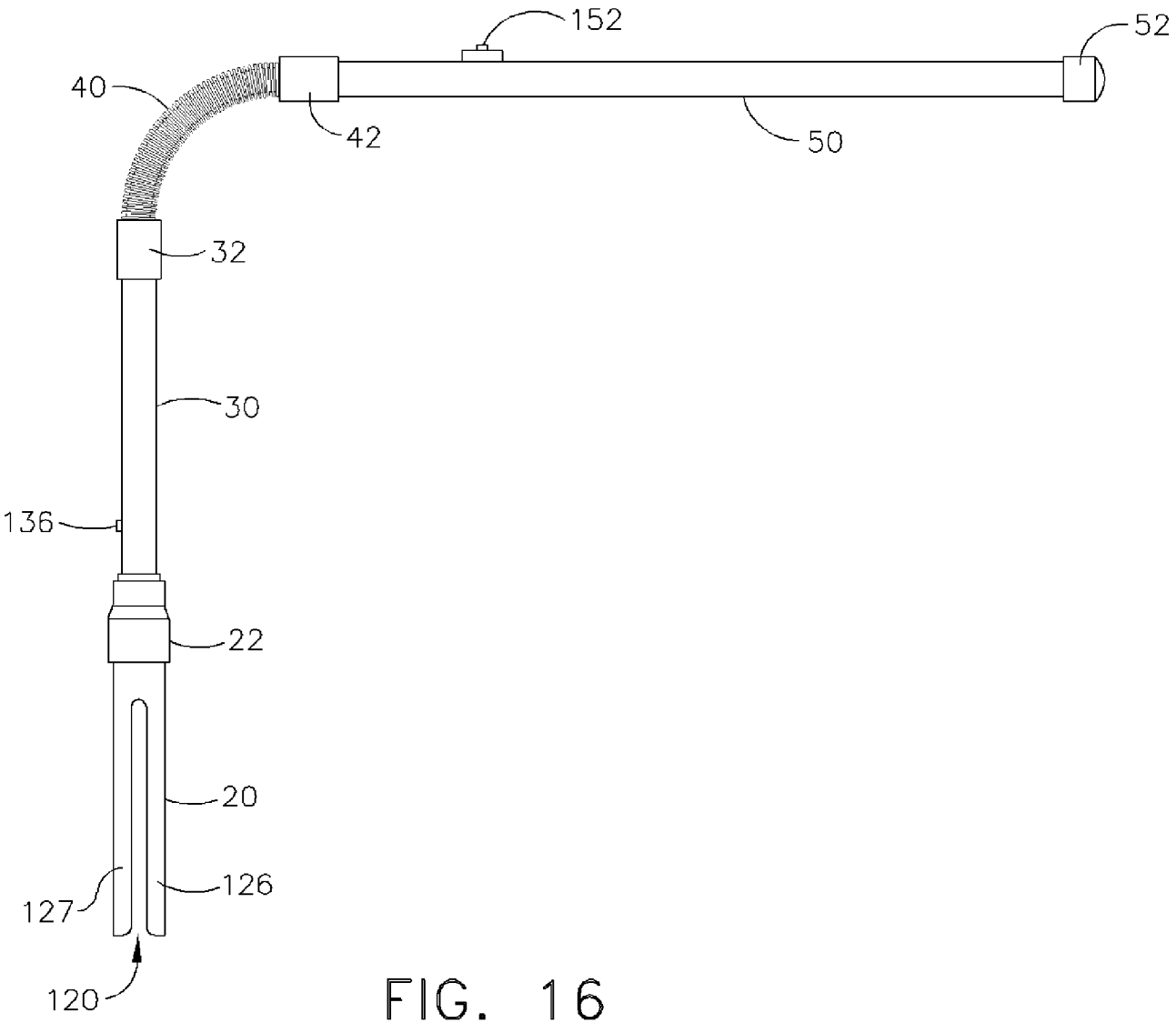
FIG. 16 is an elevational view from the side showing one-half of the framework sub-assembly used in the sun shade of FIG. 1, in which the first and second support members are at an angular configuration of about 90°, by bending the flexible support member.

Right flap 76 also includes a heavy duty female snap 179, which is used to fasten this portion of the right flap 76 to the framework of the sun shade, again at a male snap 136 (see FIG. 16). However, the snaps at 136 (FIG. 16) are optional; they can be replaced by a small hook attached to the flexible material side panels 74 and 76 (or the top panel 72), on each side of the sun shade 10, in which the small hooks would each attach to the bottom edge of the adapter 22 where it is larger in diameter than the chair connector 20. Such small hooks would apply tension to the flexible material at the bottom corners of the material (toward the rear of the chair 80).

The front flap 78 is attached or otherwise affixed to the top portion 72, and will extend down and to the "front" of the sun shade (as seen in FIG. 5). This front flap 78 is also viewed on FIG. 1. Referring to FIG. 1, it can be seen how all of four of the material pieces 72, 74, 76, and 78 are merged together to form a single sun shade material portion, typically made of a flexible material such as canvas. As discussed above, these individual portions can be affixed by stitches if desired, or by some other methodology. Furthermore, the final material shape could be cut as a single one-piece pattern that would have the combined shape of these four pieces as seen in FIG. 5, except they would be made of a single piece of material. If that is the method of construction to be used for a particular sun shade constructed according to the present invention, one must remember that the edge panels 172 and 173 should be two layers of material with an opening therebetween. The entire flexible material portion could still be made as a single pattern, but then the edge panels 172 and 173 would probably have to be stitched on or otherwise attached as a separate material layer to the top portion, at the locations seen in FIG. 5.

Figure 6A:
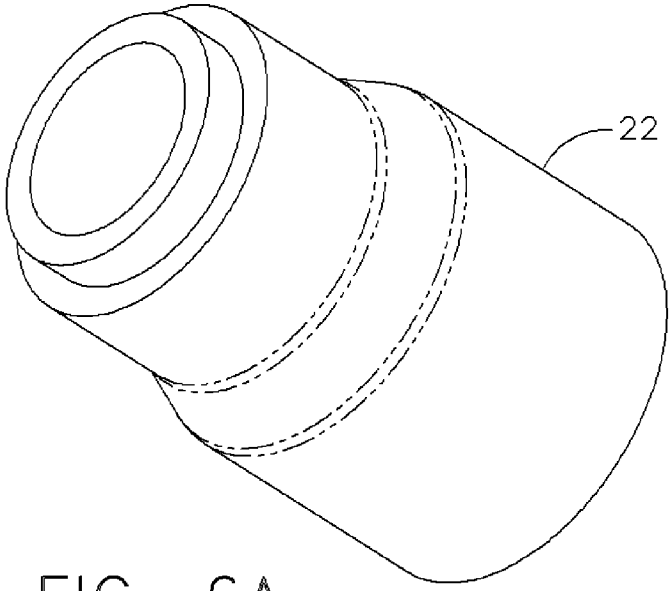
FIGS. 6A-6C are three views of an adapter that is used in the sun shade of FIG. 1.
Figure 6B:
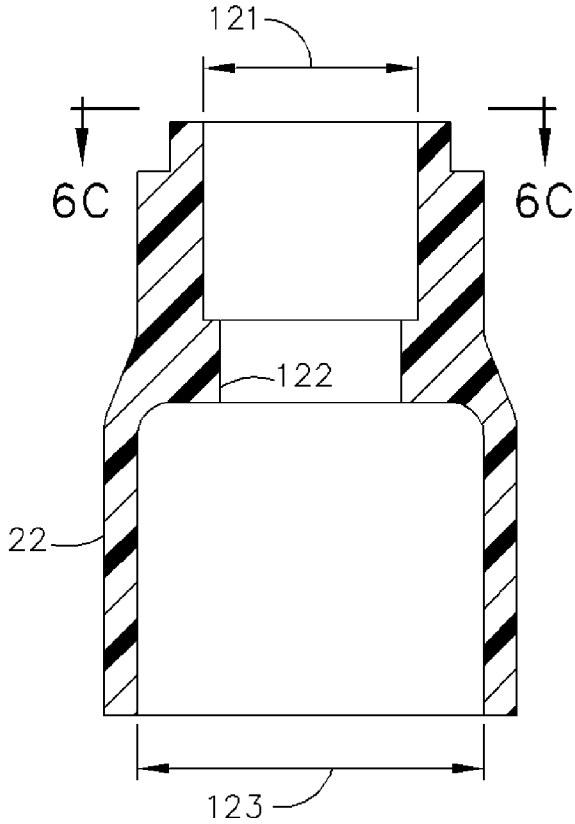
Figure 6C:
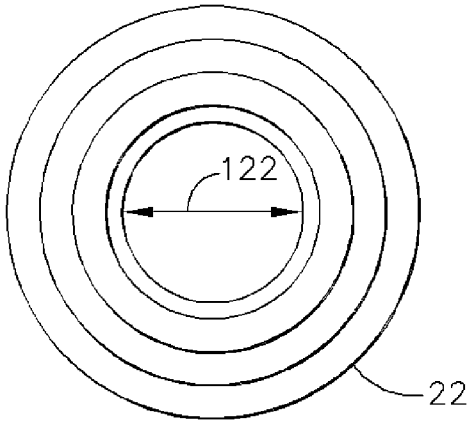

Referring now to FIGS. 6A-6C, the adapter 22 is depicted in greater detail. As can be seen in these figures, the adapter has a larger inner diameter on one end than at the other end. The larger inner diameter is depicted by the reference numeral 123 on FIG. 6B, while the smaller inner diameter is depicted at the reference numeral 121. The smaller inner diameter 121 is for mating with the first support member 30, while the larger inner diameter 123 is for mating with the chair connector 20. Of course, if these pieces 20 and 30 were made of materials of different sizes for their outer diameters, then the adapter 22 would have a different appearance. In FIG. 6B, a mechanical stop 122 is viewed, which allows the chair connector 20 and the first support member 30 to be inserted up to a predetermined distance into the inner spaces of the adapter 22.

In the first embodiment illustrated in FIGS. 2-4, the inner diameter 121 is about 13/16 inches, the inner diameter at the stop 122 is about 11/16 inches, and the inner diameter 123 is about 1 3/16 inches. The outer diameter at the larger end is about 1 9/16 inches, and the outer diameter at the narrower end is about 1 5/16 inches. The overall length (or "height" on FIG. 6B) is about 2¼ inches.

Figure 7A:
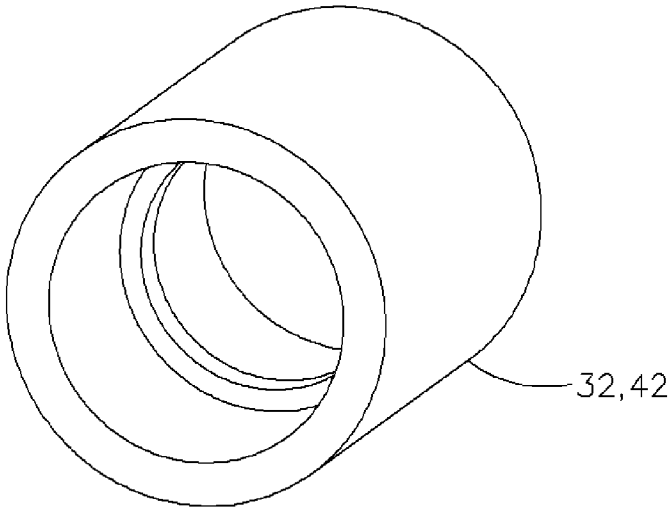
FIGS. 7A-7C are three views of a coupler used in the sun shade of FIG. 1.
Figure 7B:
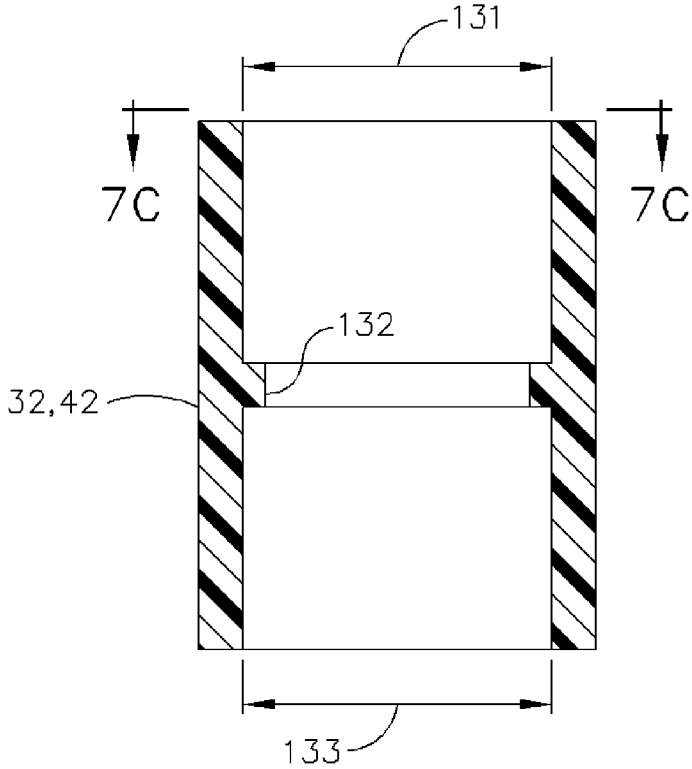
Figure 7C:
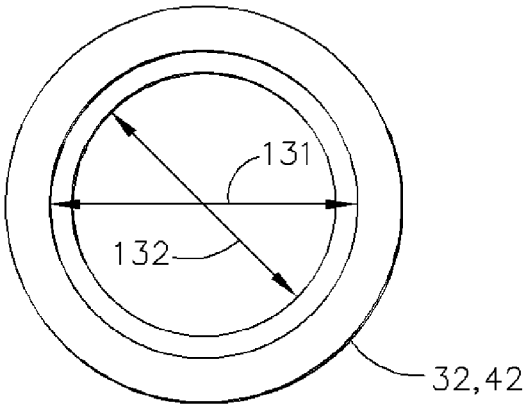

Referring now to FIGS. 7A-7C, the first coupler 32 (which is also the same type of item as the second coupler 42) is illustrated in greater detail. There are two inner diameters 131 and 133 in coupler 32, and in the first embodiment of FIGS. 2-4, the inner diameters 131 and 133 are both the same size, which is about ¾ inches in this embodiment. A mechanical stop 132 is used to limit the travel of the adjoining members, and the first inner diameter 131 is for mating with one of the frame members 30, 40, 50, or 52. The second inner diameter 133 is also used for mating with another one of those same frame members, as needed.

In the first embodiment of FIGS. 2-4, the outer diameter of coupler 32 is about 1⅛ inches, and the inner diameter at the stop 132 is about ⅞ inches. The overall length (or "height" on FIG. 7B) is about 1½ inches.

Figure 8A:
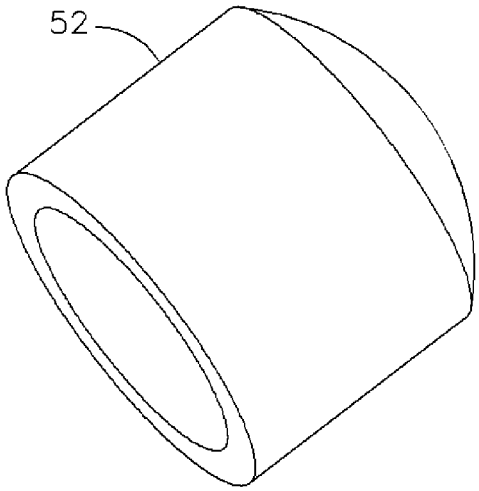
FIGS. 8A-8C are three views of an end cap that is used in the sun shade of FIG. 1.
Figure 8B:
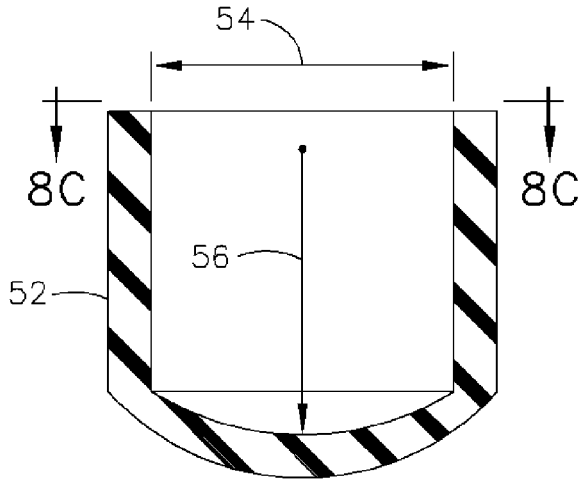
Figure 8C:
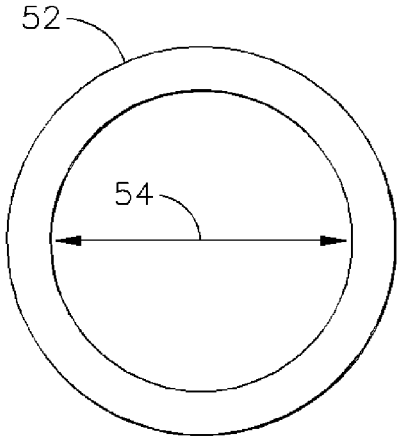

Referring now to FIGS. 8A-8C, the end cap 52 is illustrated in great detail. End cap 52 is mainly hollow and with a constant inner diameter, except at its rounded end portion. The constant inner diameter is depicted at 54, and in this first embodiment is about ⅞ inches. The rounded portion is a radius of about ¾ inches, depicted at the arrow 56. The outer diameter of the end cap 52 in this first embodiment is about 1⅛ inches, and the overall length (or "height" on FIG. 8B) is about 1 1/16 inches.

Figure 9A:
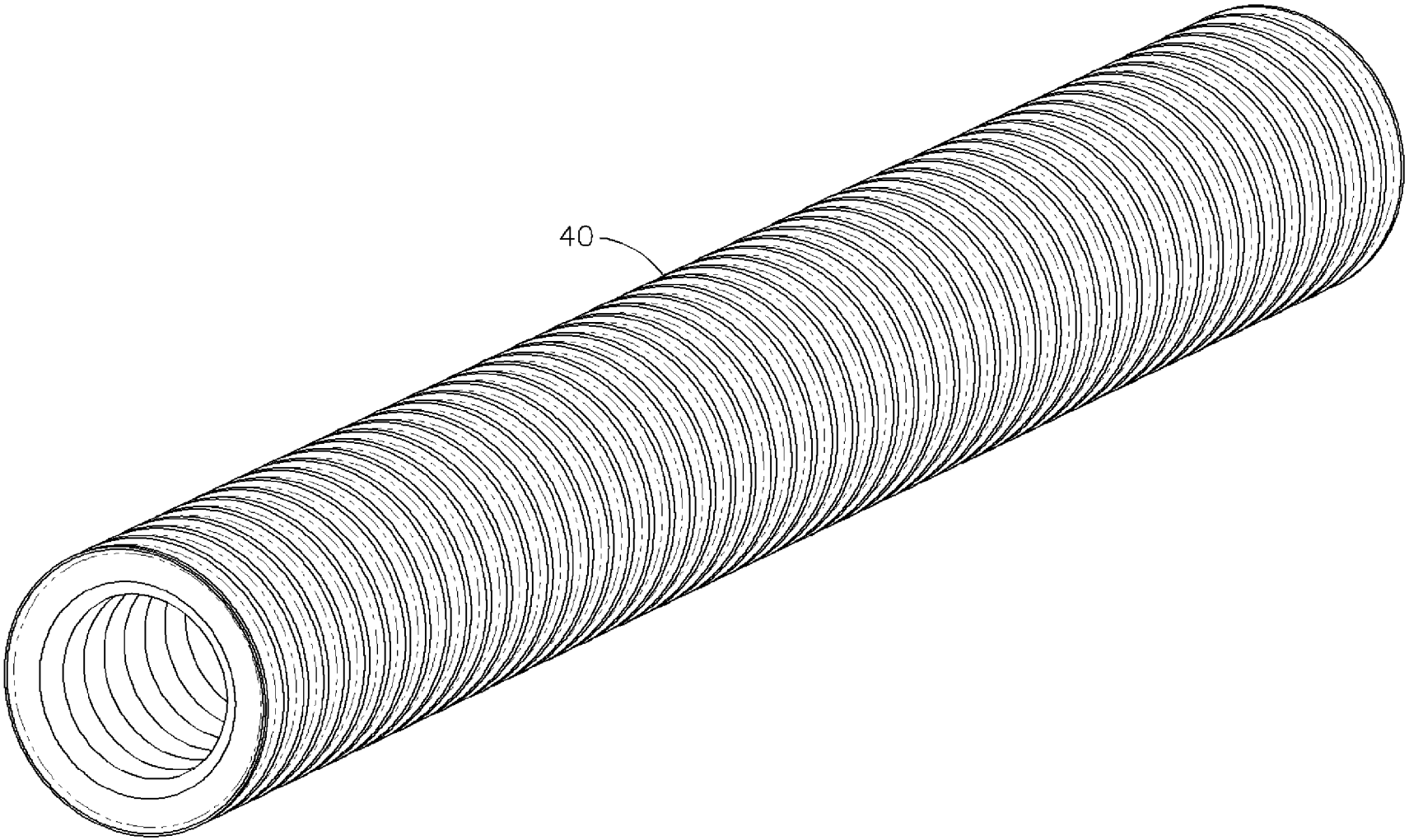
FIGS. 9A-9D are four views of a flexible support member that is used in the sun shade of FIG. 1.
Figure 9B:
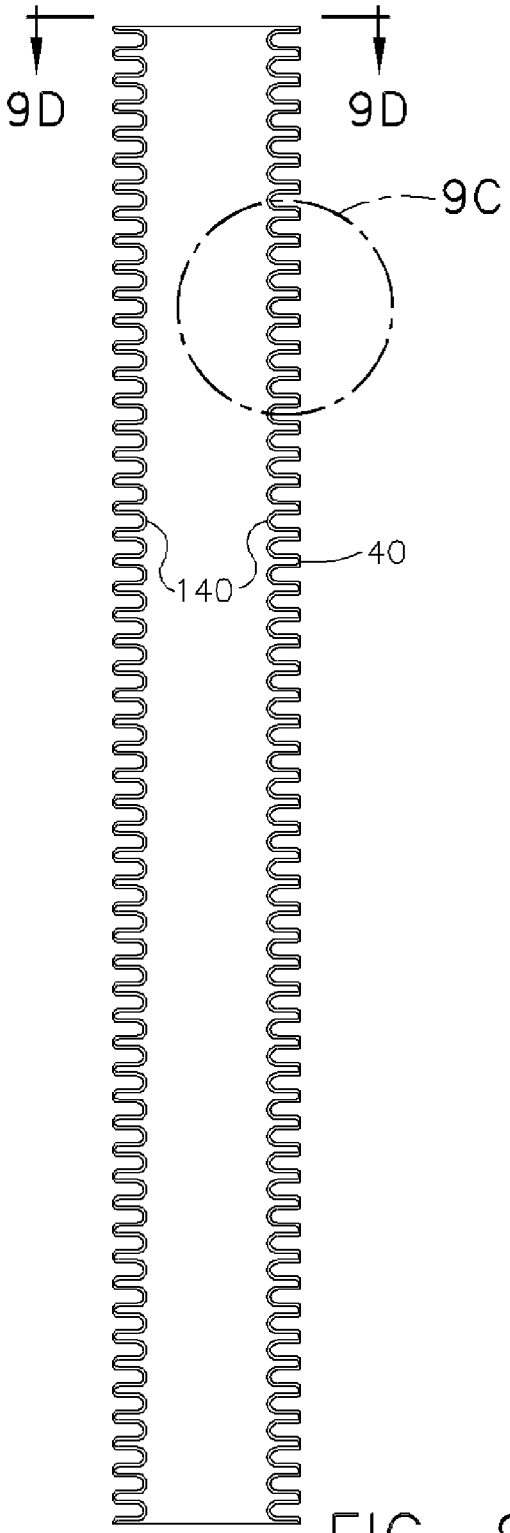
Figure 9C:
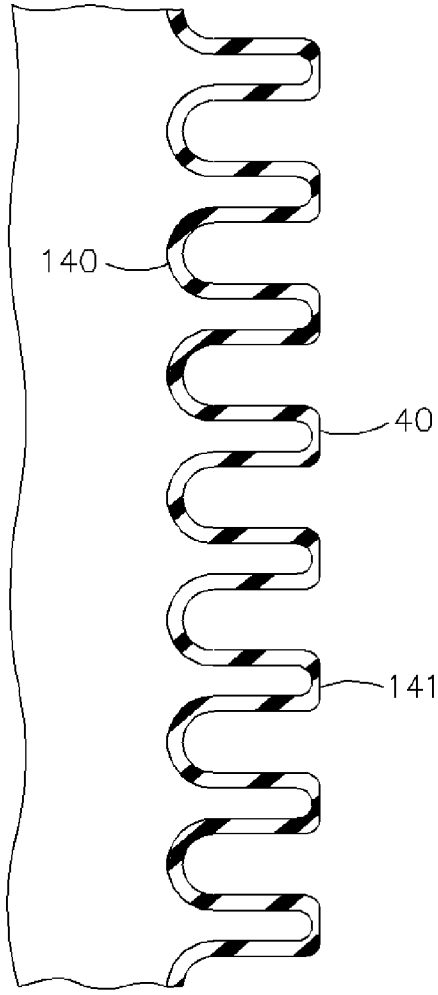
Figure 9D:
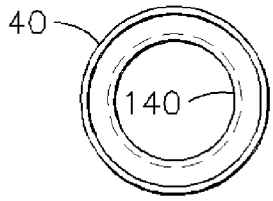

Referring now to FIGS. 9A-9D, the flexible support member 40 is illustrated in great detail. In the illustrated embodiment, flexible support member 40 has the appearance of a corrugated tube, and is constructed in a manner that has a more or less serpentine shape to its cross-section. This can be seen best in FIGS. 9B and 9C. In FIG. 9B, the cross-section of the serpentine inner surface is designated by the reference numeral 140. This can be seen in a magnified view in FIG. 9C. In FIG. 9C, the cross-section of the serpentine outer surface is designated at the reference numeral 141. It can be seen that the inner surface 140 is mainly rounded, while the outer surface 141 is rounded in certain portions but is more squared off at its protrusion portions. It will be understood that this flexible support member 40 can be made of virtually any material that will be both flexible but also substantially retain its shape when placed in different angular positions as it is bent by a user.

The main purpose of the flexible support member 40 is to allow the sun shade to be positioned at different angles, as per the user's desire. The user could leave the flexible support member "straight" as seen in the sub-assembly views of FIGS. 3 and 4, but it is more likely that the user will want to bend the flexible support member so that the sun shade top comes over in a more horizontal manner, rather than remaining in a vertical manner (as it would be in FIG. 3, for example). The function of the flexible support member 40 is illustrated more concisely in FIGS. 16 and 17, and it can be seen from these figures that the flexible support member 40 is to be allowed to bend at more than one angle. It would be best if the flexible support tube is able to retain its angular position (within certain tolerances) once the user places the sun shade at a desired angle.

The flexible support member 40 can be constructed of many different materials, and also made in many different shapes with regard to the detailed appearance of the structure, without departing from the principles of the present invention. In the illustrated embodiment of FIGS. 9A-9D, the flexible support member 40 has an outer diameter of about ⅞ inches, and a narrowest inner diameter of about 9⁄16 inches. The overall length (or "height" on FIG. 9B) is about seven inches. Referring to FIG. 9C, the radius at 140 is about 1⁄16 inches, and the spacing between outer protrusions is also about 1⁄16 inches. Of course, these spacing and other size dimensions can be altered without departing from the principles of the present invention, as best decided by the sun shade designer.

As an alternative embodiment, the flexible support member could be made to be thicker for its bottommost portion, to provide additional mechanical durability. For example, its bottom two (2) inches could have the same outer diameter (e.g., ⅞ inches), but have a wall thickness that is greater than for its uppermost five (5) inches of length.

Figure 10A:
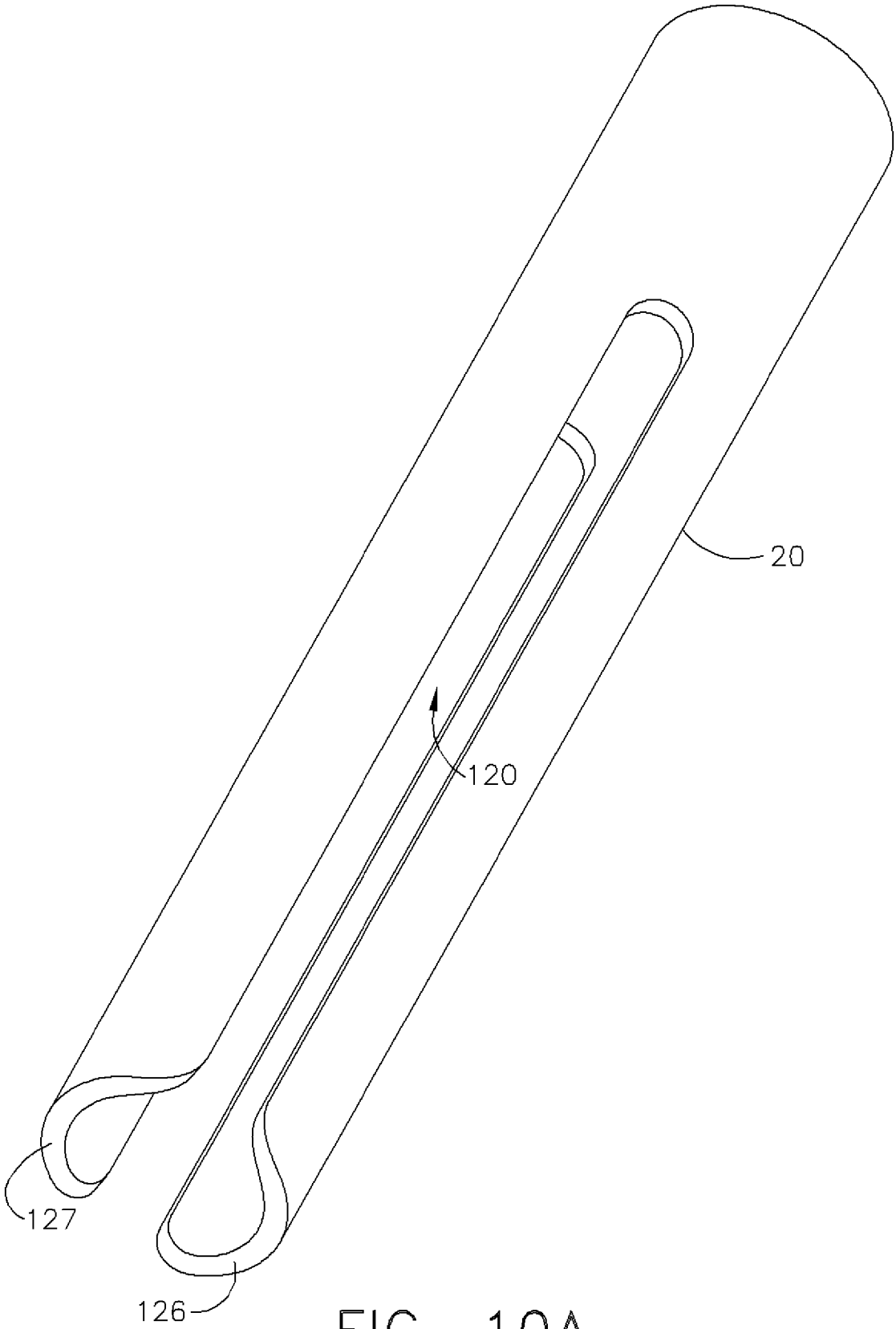
FIGS. 10A-10C are three views of a first embodiment chair connector that is used in the sun shade of FIG. 1.
Figure 10B:
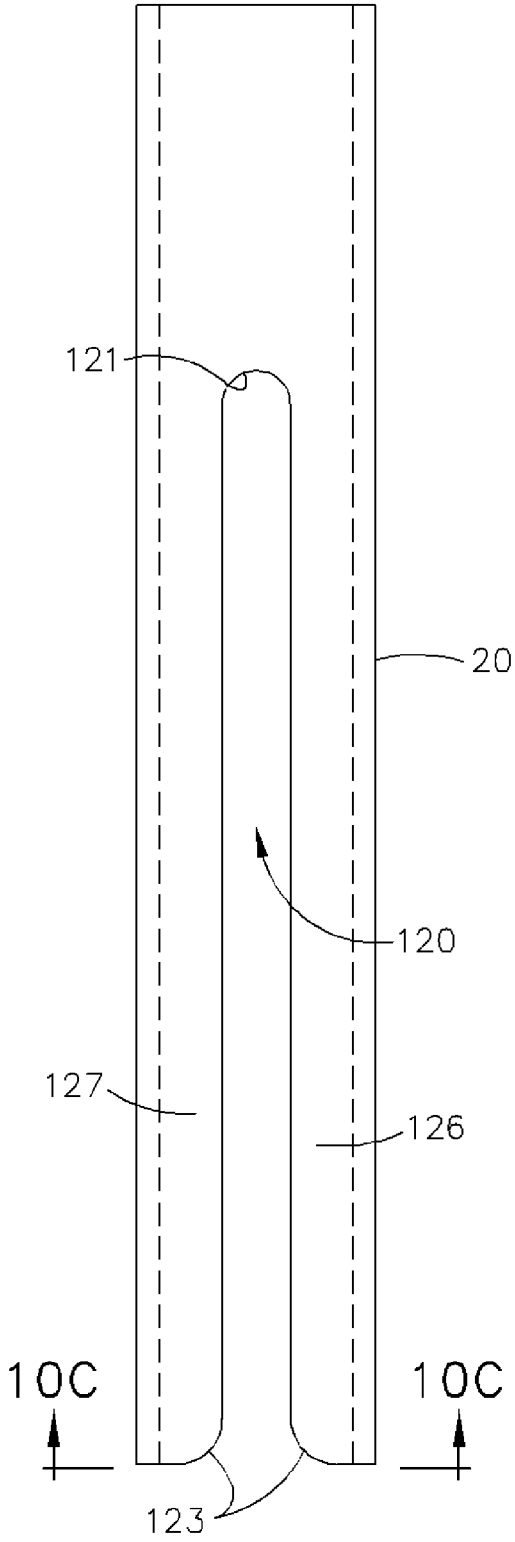
Figure 10C:
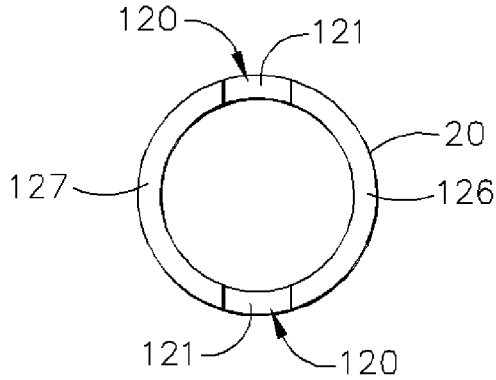

Referring now to FIGS. 10A-10C, the chair connector 20 is depicted in detail, for a first embodiment of this connector. In FIGS. 10A and 10B, an open slot area 120 can be seen, and this area is used to slide the connector 20 over portions of the canvas chair 80, so that the chair connector 20 essentially "clips" onto the back portion of the chair 80. More specifically, the connector 20 slides over the top back frame member 82 and the upper portion of the upper right rear frame members 84 on either side of the canvas chair 80. This provides the chair connector 20 with sufficient mechanical rigidity so that the sun shade 10 will remain in place and will not collapse after the chair connector 20 has been "clipped" onto the back portion of the chair 80. When the chair connectors 20 are in place on a chair, they are essentially "affixed" to the chair, because the chair connectors will hold their position without any additional fasteners or locking hardware.

The opening or slot 120 in the side walls of the chair connector 20 preferably are large enough to fit over the frame members of many different manufacturers and models of canvas chairs. At the same time, the slot 120 should not be too large, or it would easily slip off of the canvas chair framework. In the first illustrated embodiment of FIGS. 2-4, the chair connector 20 is about eight inches in overall length (or "height" on FIG. 10B), and the slotted region 120 is about six inches in length. The inner radius of the opening of the slot (at 121) is about 3⁄16 inches. The outer radius of the slotted area (at 123) is about ¼ inches. The outer radius of the overall chair connector 20 (see FIG. 10C) is about 1 5⁄16 inches, while the overall outer diameter is 1 5⁄16 inches, and the overall inner diameter of the chair connector is about 1 1⁄16 inches.

In the illustrated embodiment of FIG. 10A, the chair connector 20 could have reinforcing material near the slot area 120, if desired. Such reinforcing material could provide extra mechanical strength at points where the major mechanical load is going to be imparted from the canvas chair 80 to the sun shade overall structure. More specifically, these points at the chair connector 20 (that essentially is a press fit device) are where it meets the mechanical loading stresses at the top back frame 82 of the chair right at the end of the slot (at 121). It will be understood that such reinforcing material is not always necessary, depending upon the thickness and the type of material used for the chair connector 20.

The chair connector 20 has two main portions or "halves" at 126 and 127, which are separated by the slot area 120. While the chair connector 20 is made of a fairly strong and rigid material, it is not so rigid that the two halves 126 and 127 cannot be spread apart by a small distance when the sun shade 10 of the present invention is in use (i.e., they have some flexibility, or "give"). This is a desirable feature, as will be discussed below in connection with FIG. 18.

Figure 11A:
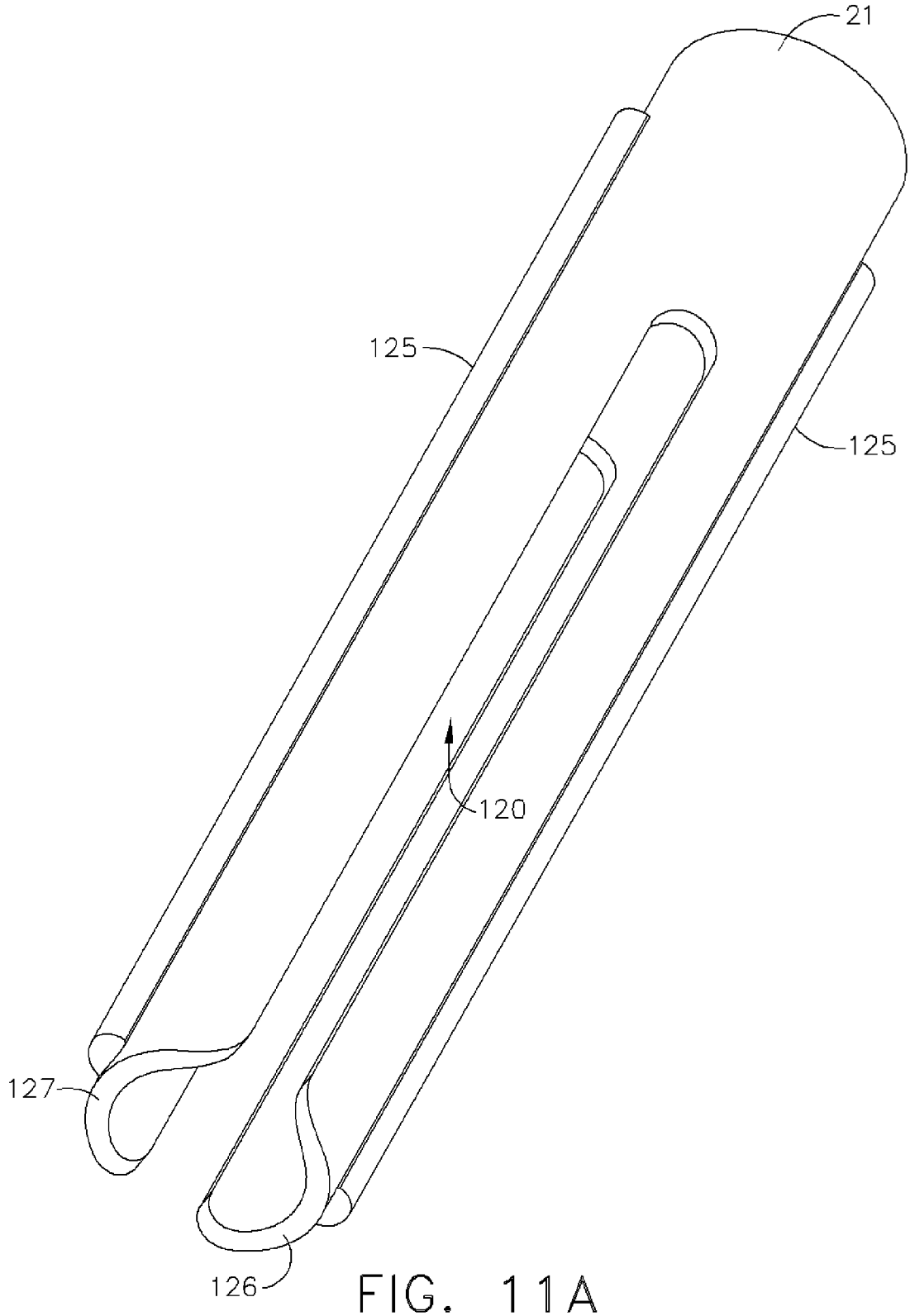
FIGS. 11A-11C are three views of an alternative embodiment chair connector that is used in the sun shade of FIG. 1.
Figure 11B:
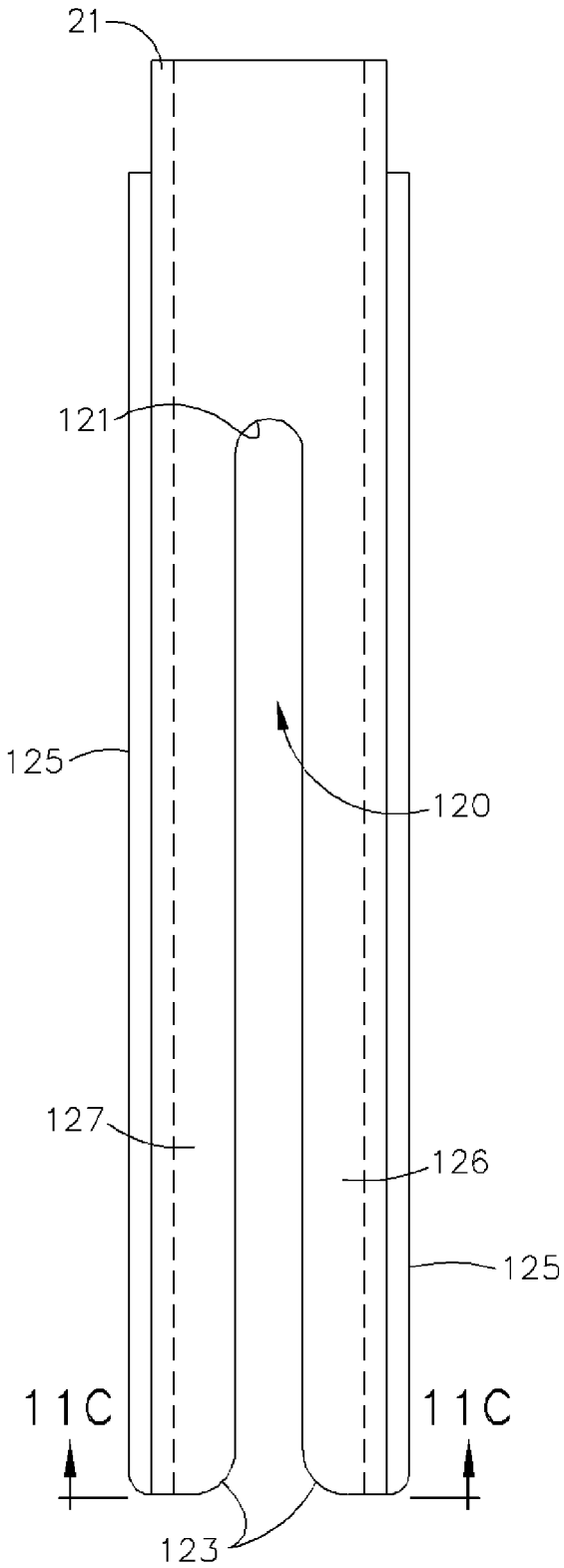
Figure 11C:
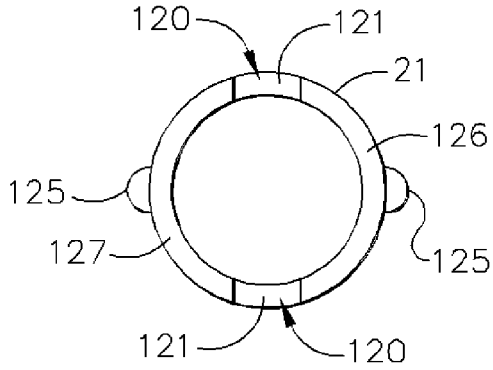

A second embodiment chair connector is illustrated in greater detail in FIGS. 11A-11C. This second embodiment chair connector is generally designated by the reference numeral 21. Generally speaking, the second embodiment chair connector 21 is quite similar to the first embodiment chair connector 20 in most ways. The dimensions can be the same and the materials used can be the same. However, in the second embodiment chair connector 21, there is a pair of reinforcement ribs at 125. These reinforcement ribs will also help to sustain the mechanical loading requirements of the chair connector 21 when it is slipped over the top-rear portions of a canvas chair 80. It will be understood that the reinforcement ribs 125 may not be necessary for a particular chair connector, depending upon its thickness and the material it is made from. In the illustrated embodiment of FIG. 11B, the reinforcement rib 125 is about ⅛ inches in thickness.

Figure 12A:
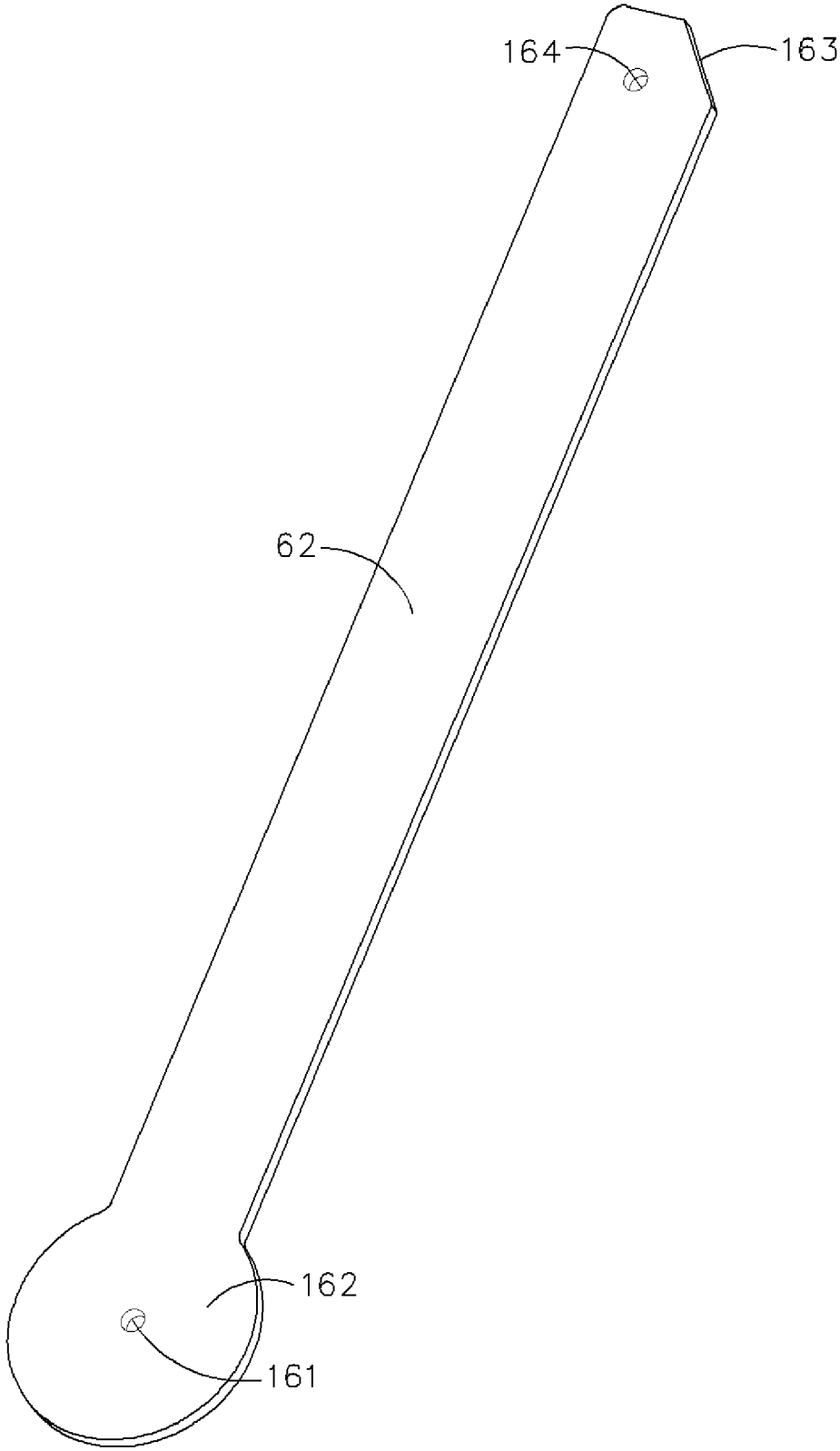
FIGS. 12A-12C are three views of a stretcher support arm that is used in the sun shade of FIG. 1.
Figure 12B:
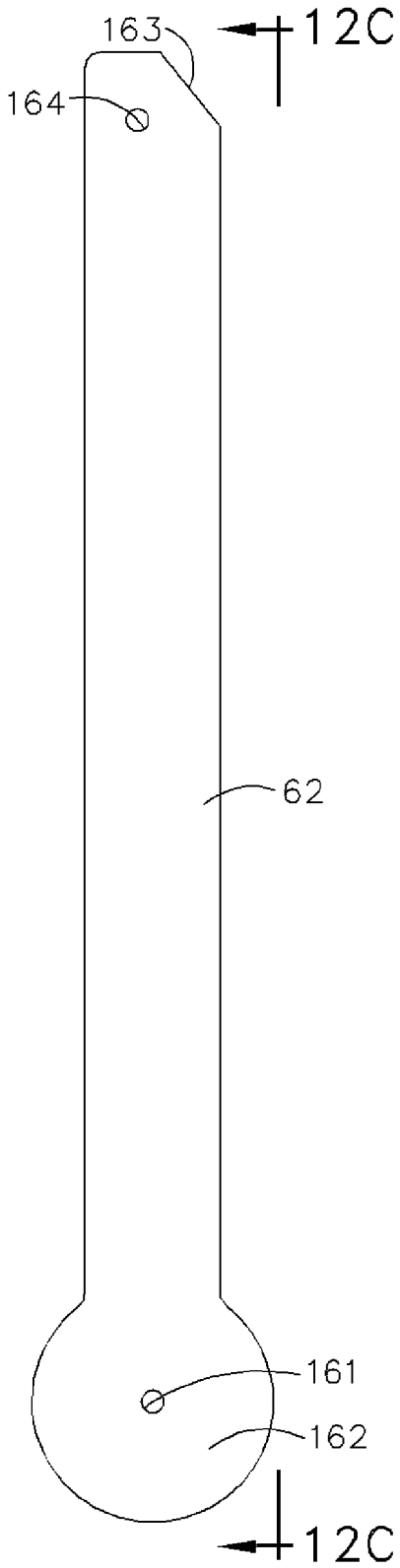
Figure 12C:
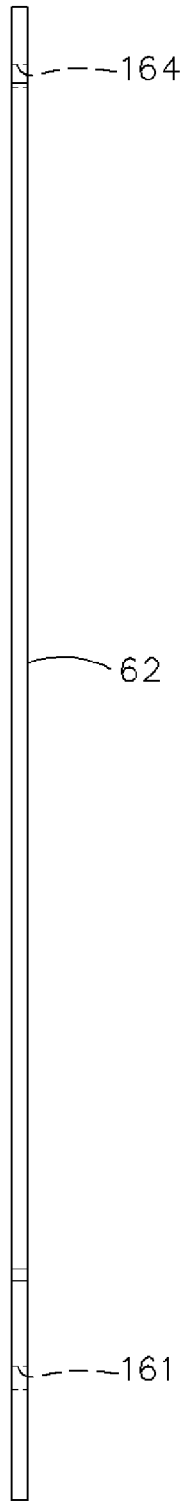

Referring now to FIGS. 12A-12C, the "stretcher support arm" 62 is illustrated. It will be understood that this arm 62 does not itself "stretch," but instead this arm is used to provide tension to the flexible material top 72, and in effect it tends to stretch that material. This stretcher support arm 62 has a rounded end at 162 and also a straight but angled end at its opposite end. At the rounded end 162 there is an opening 161. On the opposite end the angled portion is depicted at 163, and there is also an opening near that end at 164. The opening 161 acts as a pivot point opening that mates with one of the second support members 50. This configuration can best be seen on FIGS. 3 and 4. At the opposite end, the opening 164 also acts as a pivot point opening and mates with a pivot pin at a location 166 of the pivotable locking member 60, and this is best seen on FIG. 15B. The angled portion 163 at this angled end acts as a mechanical stop within the pivotable locking member 60. This essentially allows the two stretcher support arms 62 and 64 to "lock" in place within the pivotable locking member 60, at times when the stretcher support arms are co-linear, as illustrated in FIGS. 3 and 4. When in this configuration, the top material portion 72 is then being stretched to its maximum extent by the cross-frame sub-assembly 66.

In the first embodiment illustrated in FIGS. 2-4, the first stretcher support arm 62 is about 12 3⁄16 inches in overall length (or "height" on FIG. 12C), and is about ⅛ inches in thickness. The rounded end 162 has a radius of about one inch, and has a width of about 1⅛ inches (see FIG. 12B). It will be understood that the second stretcher support arm 64 is essentially identical to this first arm 62 illustrated on FIGS. 12A-12C, except the second arm 64 has its angled portion 163 on the opposite side of the end near the opening 164. In reality, both of the stretcher support arms 62 and 64 could probably be made of the same exact shape, just by flipping from one side to the other (and then used on the opposite side of the sun shade sub-assembly depicted in FIGS. 2-4).

Referring now to FIGS. 13A-13C, the first support member 30 is illustrated in greater detail. First support member 30 is generally cylindrical, and has an opening at 135 in its side wall. This opening 135 is used to locate a male snap, such as the snap 136 that is illustrated on FIG. 16. The snap can be positioned by different mechanical arrangements, including a nut and bolt, or simply a male snap that has a bolt or other type of mechanical attachment (such as a pop rivet) that works on the opposite surface of its holding member.

There could be reinforcing material in the illustrated embodiment of FIG. 13A near the opening 135, if desired. While such reinforcing material may be desirable, it will be understood that it may not be necessary, depending upon the thickness of the first support member and on the material used for its construction. In the illustrated embodiment of FIG. 13B, the first support member is about 8 15/16 inches in length (or in "height" on FIG. 13B). Its outer diameter is about 7/8 inches, and its inner diameter is about 5/8 inches.

Figure 14A:
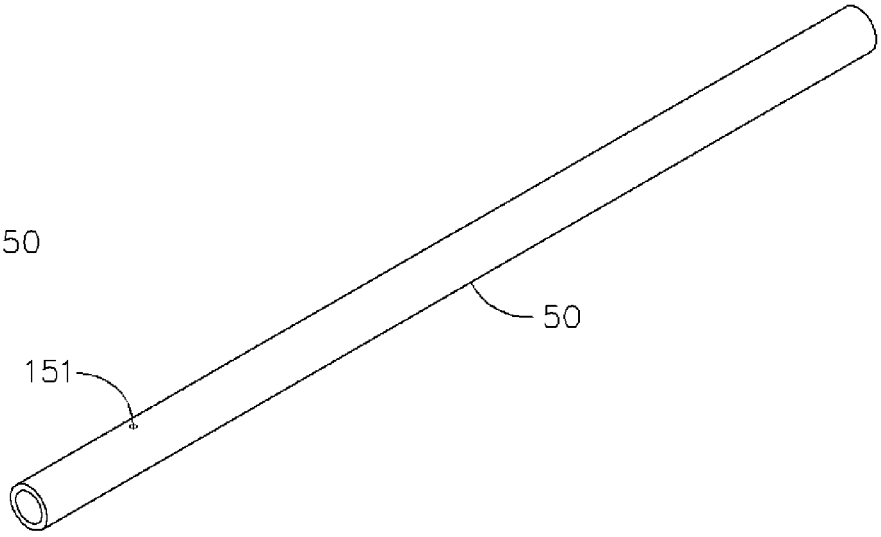
FIGS. 14A-14C are three views of a second longitudinal support member that is used in the sun shade of FIG. 1.
Figure 14B:
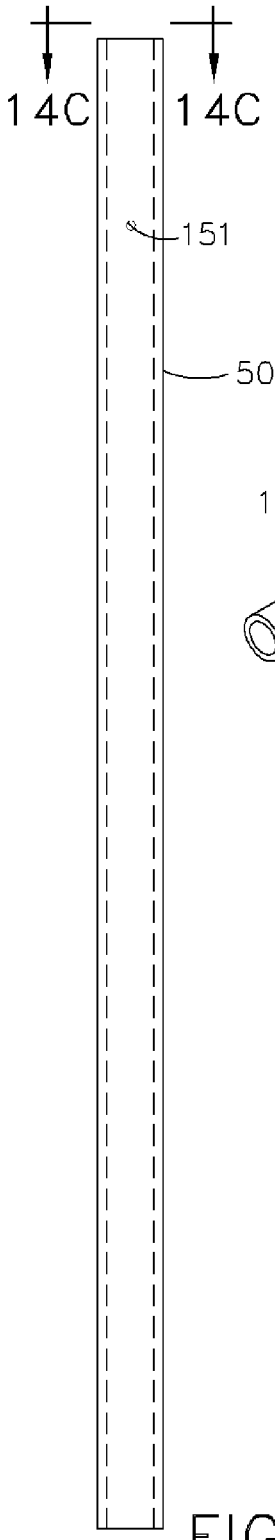
Figure 14C:
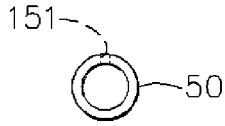

Referring now to FIGS. 14A-14C, the second support member 50 is illustrated in greater detail. This second support member is another generally cylindrical part, and it also has an opening at 151 in its side wall. Reinforcing material may also be included along the side wall near opening 151, if desired. It will be understood such reinforcing material may not be necessary, depending upon the thickness of the material and the type of material used for the support member's construction.

The second support member 50 has an overall length of about 19 15/16 inches (or in "height" in FIG. 14B). The outer diameter is about 7/8 inches, while the inner diameter is about 5/8 inches. The opening 151 in the side wall of the second support member 50 is used for locating a protrusion or some type of attachment device such as a screw or bolt that will act as a pivot point for the rounded end of the first and second stretcher support arms 62 and 64.

Figure 15B:
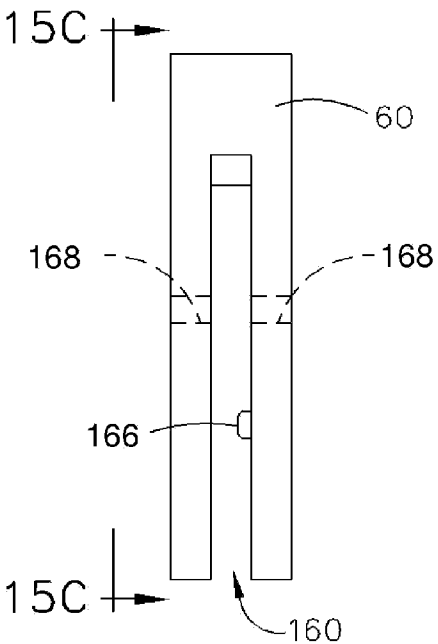
FIGS. 15A-15C are three views of a pivotable locking member that is used in the sun shade of FIG. 1.
Figure 15A:
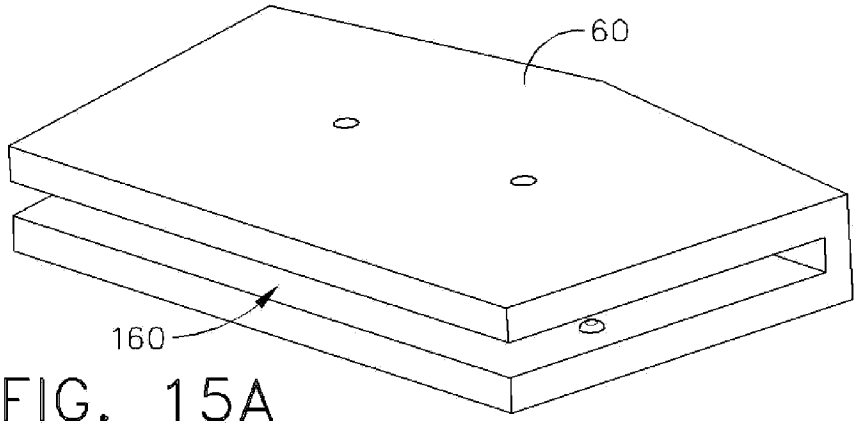
Figure 15C:
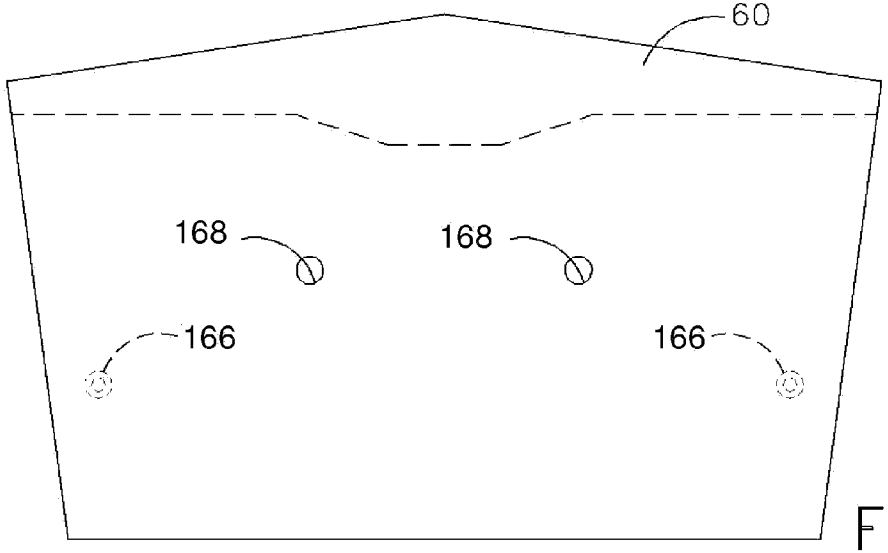

Referring now to FIGS. 15A-15C, the pivotable locking member 60 is illustrated in greater detail. There is a slotted opening 160 that runs through the majority of the outer surface area of the locking member 60 in a longitudinal direction. This can best be seen in FIG. 15B. Within the slotted opening 160 is a protrusion 166; actually there are two such protrusions 166, as best seen on FIG. 16C, and one of these protrusions will be used as a mechanical stop for each of the stretcher support arms 62 and 64. This helps to "lock" the two stretcher support arms 62 and 64 in place once they become substantially co-linear with one another.

The locking member 60 allows the stretcher support arms 62 and 64 to pivot (about pivot points 166) so that the overall sun shade 10 can be collapsed into a smaller size for carrying purposes, and also so it can be put into some type of carrying bag, if desired. Such a collapsed position is depicted in FIG. 23. At the same time, the locking member 60 allows the stretcher support arms 62 and 64 to be pivoted to a point where they become substantially co-linear, at which time they are "locked" in place to stretch the top portion of the flexible material. This configuration is shown in FIG. 22.

In FIG. 15B, the overall width is about 9/16 inches for this illustrated embodiment, and a slotted opening is about 3/16 inches in width. In FIG. 15C, the overall width of the locking member 60 is about 4 1/16 inches, and the overall height (in this view) is about 2 7/16 inches.

Within the main body portion of the locking member 60 are two openings 168 as seen on FIG. 15B. Actually there are two pairs of these openings, as seen on FIG. 15C. These openings are used to hold fasteners or pivot members that will hold the pivoting stretcher support arms 62 and 64 in place within the pivotable locking member 60. (These fasteners are not shown in FIGS. 15A-15C.)

Referring now to FIG. 16, a side view of the overall assembly of one of the framework halves 15 (without the flexible material) is illustrated. At the "bottom" (in this view) is the chair connector 20, with its slotted opening at 120 that is used to "press fit" over portions of a canvas chair, such as the canvas chair 80 depicted in FIG. 1. The rest of the components in FIG. 16 are essentially identical to the first embodiment components depicted on FIGS. 2-4; there is an adapter 22, a first support member 30, a first coupler 32, a flexible support member 40, a second coupler 42, a second support member 50, and an end cap 52. In FIG. 16, the flexible support member 40 allows the first and second support members 30 and 50 to be configured at about a 90° angle. In this manner, the second support member can be substantially horizontal while the first support member 30 is substantially vertical (in this view). This is the configuration essentially depicted in FIG. 1.

FIG. 16 also shows a screw or bolt 152 that is attached to the second support member 50. This screw/bolt hardware is used to hold one of the first and second stretcher support arms 62 or 64 in position on either one of the second support members 50 that make up the entire assembly of the sun shade 10.

Figure 17:
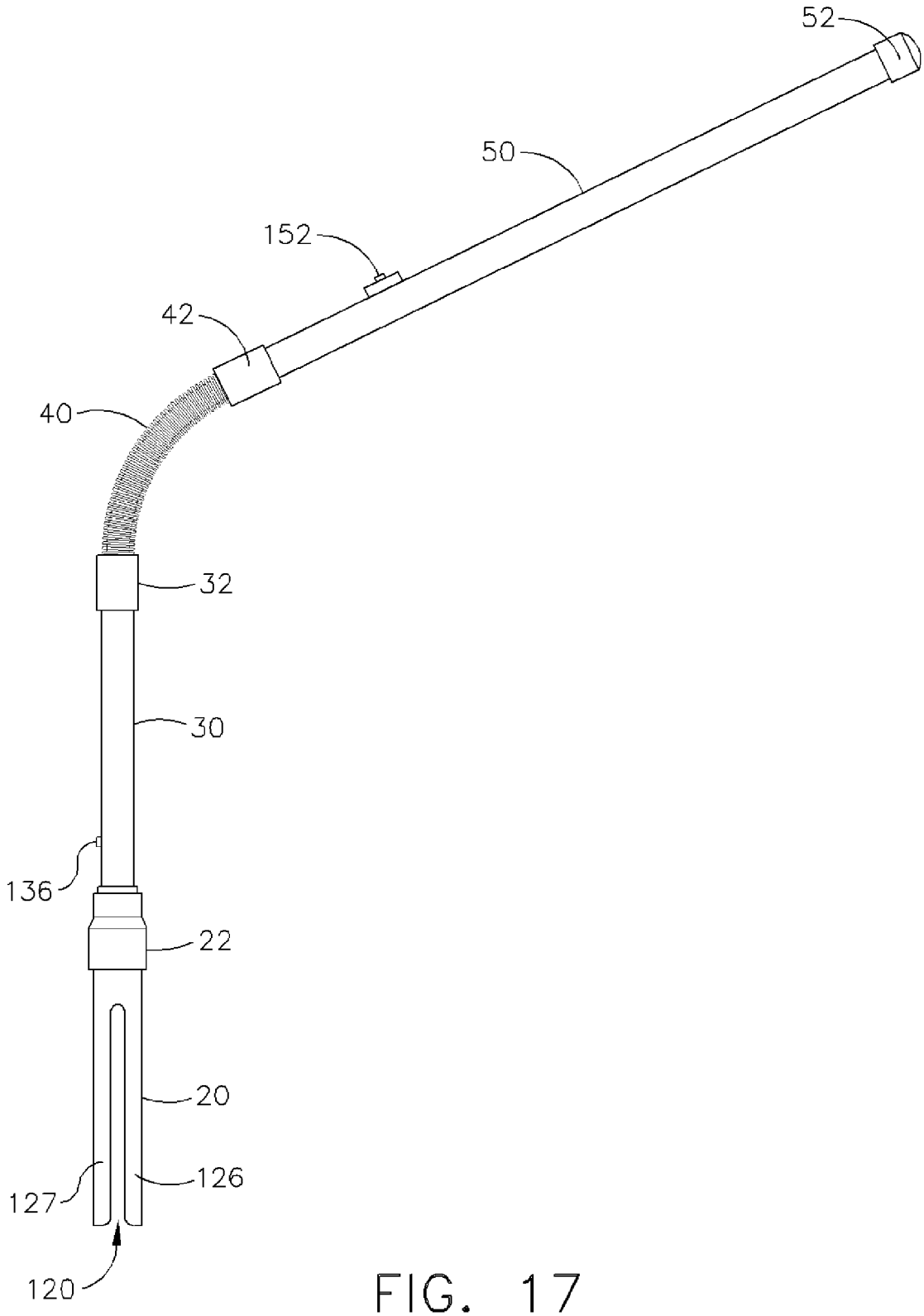
FIG. 17 is an elevational view from the side showing one-half of the framework sub-assembly in which the first and second support members are at an angular configuration that is not 90°, by not bending the flexible support member.

Referring now to FIG. 17, the same hardware as illustrated in FIG. 16 is now depicted in a different angular configuration, in which the second support member 50 is tilted at an angle that is not substantially horizontal (in this view). This is a possible configuration that a user may select for use of the sun shade 10. As discussed above, this is made possible by use of the flexible support member 40, which will allow the angular orientation between the first and second support members 30 and 50 to be essentially anywhere between 0° and at least 90° (which was shown on FIG. 16).

Figure 18:
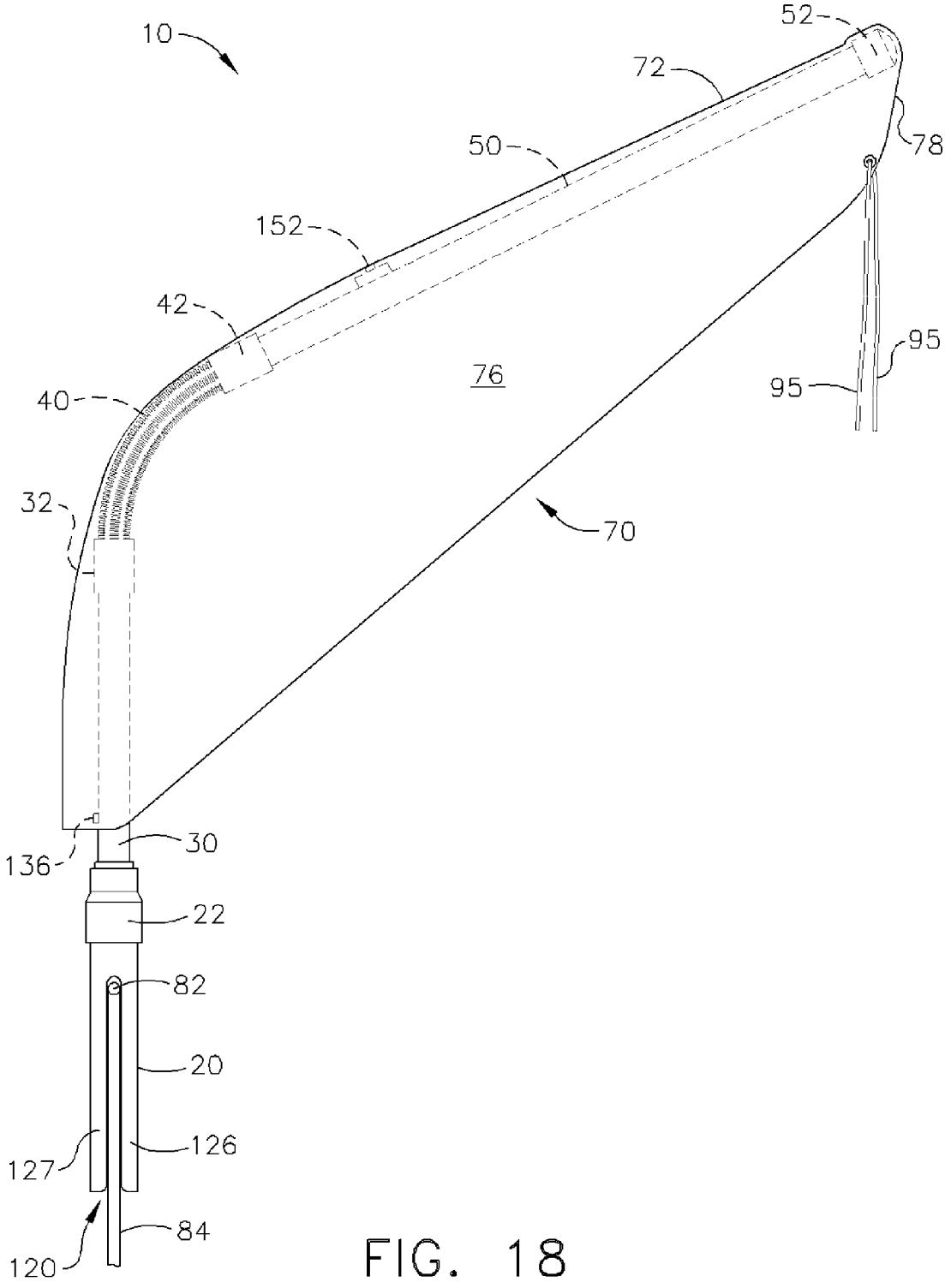
FIG. 18 is an elevational view from the side showing the entire sun shade of FIG. 1, including the flexible material covering.

Referring now to FIG. 18, the entire sun shade 10 is depicted in a side view, in which the support members 30 and 50 are in the same angular orientation as those depicted in FIG. 17. Most of the framework members are depicted in dashed lines in FIG. 18, because they are hidden behind the flexible material covering 70. The right flap 76 can be seen, as well as the edge of the top portion 72 and of the front flap 78. Moreover, pairs of retainer strings 95 also can be seen in FIG. 18.

FIG. 18 also shows some details as to how the upright rear frame member 84 and the top back frame member 82 of a portable canvas chair would be press fit into the open slotted area 120 of the chair connector 20. As can be discerned from this view, the two halves 125 and 126 of the chair connector 20 can be spread apart from one another to a certain extent to allow the frame members of the canvas chair 80 to be pushed upward (in this view) and further into the slotted area 120 of the chair connector 20. This allows frame members having various frame element sizes to be used with a single sun shade apparatus 10; if the chair has a larger diameter frame element, then that frame element would not necessarily be pushed as far "up" the slot 120 before it gets to a position where it essentially is locked into place by the press fit nature of the chair connector 20. Also, it will be understood that the canvas back support portion 92 of the canvas chair 80 will essentially run along the same plane as the upright rear frame member 84, and the slotted opening 120 of the chair connector 20 of the sun shade 10 of the present invention will allow the canvas back support portion to not be interfered with as the chair connector 20 is being placed into its proper position on the chair.

It can be seen from FIG. 1, that the two press fit chair connectors 20 do not have to be positioned in a purely vertical manner. Instead, they can be angled somewhat inward (as seen in FIG. 1) or outward, as desired or as needed to be press fit over the outer top corners of the rear framework of a canvas chair. In this manner, canvas chairs of different widths can be easily accommodated without the need for adjustable hardware that locks or unlocks the physical orientation of the chair connectors, as compared to the overall framework of the sun shade 10.

A first alternative embodiment of the framework of the sun shade of the present invention is illustrated in FIGS. 19 and 20. In FIG. 19, the chair connector 20, adapter 22, first support member 30, and first coupler 32 are all merged into a single part, which is generally designated by the reference numeral 200. In this alternative embodiment, the chair connector is at reference numeral 220, and the first support member is at reference numeral 230. If these two members are not of the same outer diameter, then there would be an adapter-type change in diameter at 222. Also, a coupler 232 could be placed at the right end (as seen on FIG. 19) for mating with the flexible support member portion that is discussed in FIG. 20.

Referring now to FIG. 20, the flexible support member is at 240, and a second support member is at 250, which has an end cap portion at 252. These three elements are all included in a single part, which is generally designated by the reference numeral 255. The "first part" 200 and the "second part" 255 are to be mated together to make a complete half-portion 215 of the sun shade framework of the present invention (similar to the framework half 15). It will be understood that the coupler 232 could be placed at the end of either one of the parts 200 or 255. Moreover, if the inner diameter of the first support member 230 would fit the outer diameter of the flexible support member 240, then there would be no need for the coupler 232.

As a second alternative embodiment, the entire half-portion of the framework sub-assembly could be constructed as a single piece. Such a single piece is depicted in FIG. 23, and is generally designated by the reference numeral 300. In FIG. 23, there is a press fit chair connector 320, a first support member 330, a flexible support member 340, a second support member 350, and an end cap 352. These could all be manufactured as a single part, and all from the same material, if desired. Of course, special attention would have to be made to be sure that the flexible support member 340 was designed correctly so as to be sufficiently flexible but also sufficiently rigid, while being made of the same material as the chair connector 320, which also must be sufficiently rigid and still have a small amount of flexibility for its slot area 325 to be able to be spread a small distance to allow the insertion of the upper framework of a canvas chair.

It will be understood that the first embodiment illustrated in FIGS. 2-4 is mainly made of standard parts that can be readily purchased (such as PVC pipes) and then machined or otherwise drilled and milled to make the custom pieces that make up the individual parts that are depicted in the exploded view of FIG. 2. The alternative embodiments depicted in FIGS. 19-21 would be specialized parts that probably would be made from plastic molds. While these parts would be certainly cheaper to manufacture once the molds are available, the molds themselves of course would add a great amount to the initial cost of manufacture.

Referring now to FIG. 22, the top portion of the sun shade framework of the present invention is illustrated, in which the first and second stretcher support arms 62 and 64 are in their substantially co-linear position, which is the "stretched" position for making the top flexible material portion 72 substantially taut. The second support members 50 are depicted on FIG. 20, but are also listed as being second support members 250 or 350, since any of those designs for the alternative embodiments could be used in the depicted view of FIG. 22. The first and second support arms 62 and 64 each have a longitudinal axis, and in this configuration, those two longitudinal axes are substantially co-linear to one another; this mechanical arrangement essentially locks the first and second support members 50, 250, or 350 into a distal spaced-apart position.

FIG. 23 shows the same parts, including the alternative embodiment parts 250 and 350 for the second support members. In FIG. 23, the first and second stretcher support arms 62 and 64 are no longer co-linear, but have been pivoted so that the second support members (e.g., at 250) can be pushed closer together, for ease of storage and transport. The pivoted arms 62 and 64 can be rotated to a point where they essentially are touching one another, at which point the second support members 50, 250, or 350 would be at their closest proximity to one another, as well as the other portions of the framework and also the flexible material covering 70 (not shown in FIG. 23). Such a compact configuration would be easily placed into a small storage (or carrying) bag that is long enough to hold the entire framework 12, but would only be a few inches in cross-section with a small opening at one end. This is a preferred mode for constructing the present invention, such that the carrying bag could easily be sold along with the entire sun shade 10 of the present invention, or any of the alternative embodiments (e.g., 250 or 350). Thus, when the first and second support arms 62 and 64 are completely pivoted about the locking member 60 and their respective support members 50, 250, or 350, the respective longitudinal axes of support arms 62 and 64 will become substantially parallel to one another, and the two support members 50, 250, or 350 are essentially collapsed onto a proximal position (similar to that depicted on FIG. 23, but actually the support members would be closer to one another than illustrated).

Figure 24:
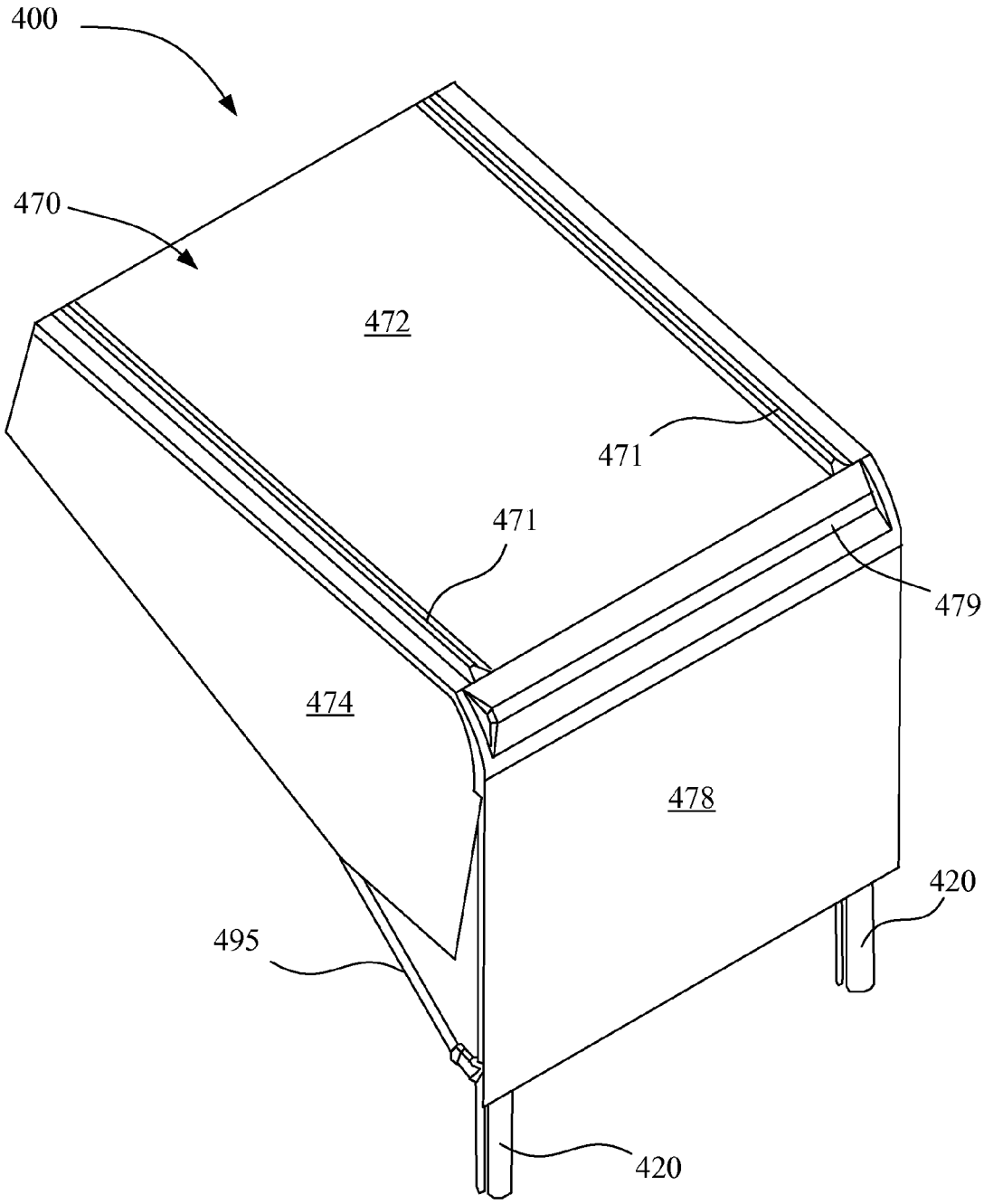
FIG. 24 is a perspective view from the left and rear side of a sun shade of a third alternative embodiment, and as constructed according to the principles of the present invention.

As a third alternative embodiment, the framework sub-assembly could be constructed of fewer parts, and an example of such an embodiment is depicted in FIGS. 24-32. This third alternative embodiment is generally designated by the reference numeral 400, as seen in FIG. 24. In this FIG. 24, the entire sun shade is depicted, including the panels of the covering material.

Figure 25:
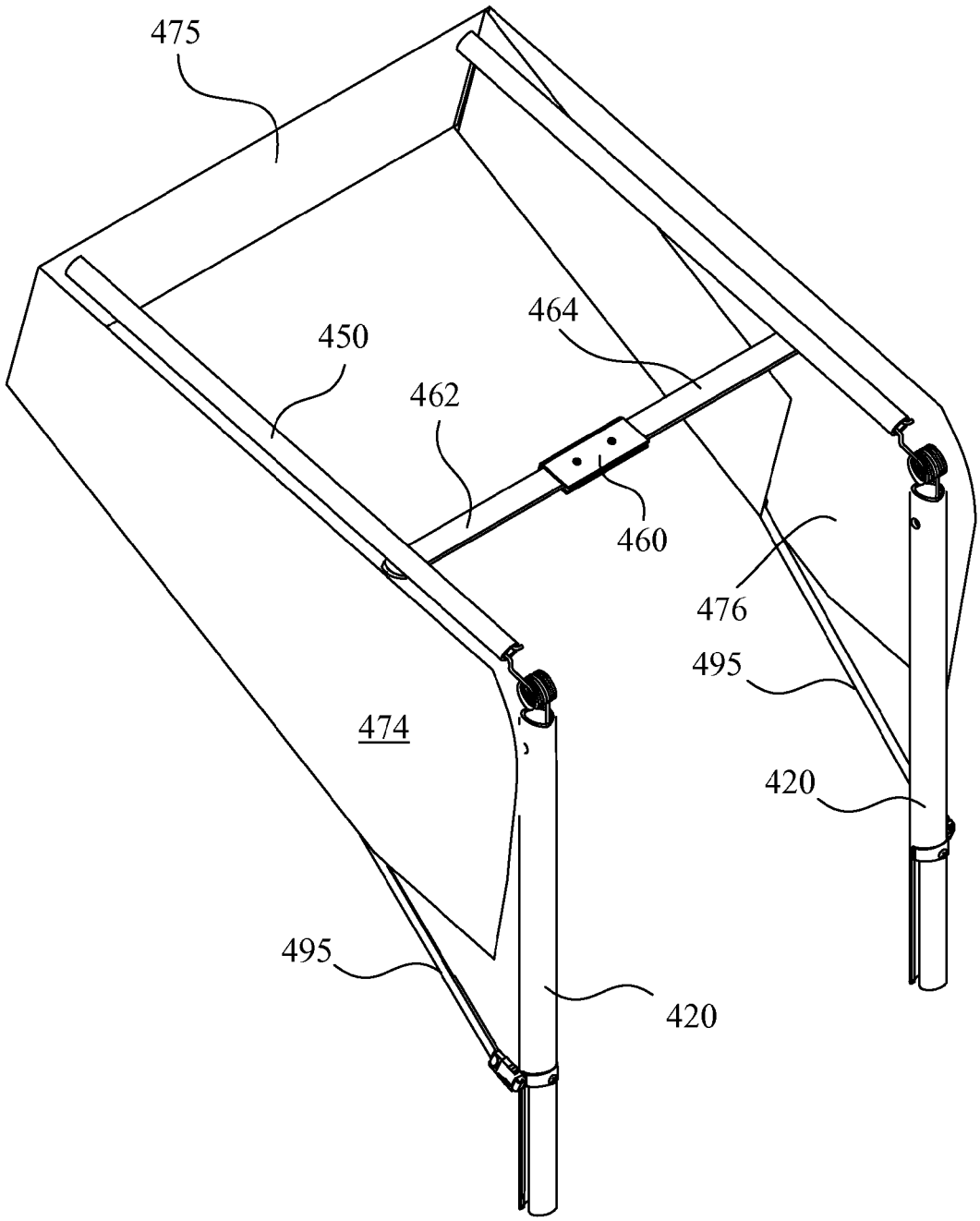
FIG. 25 is another perspective view of the sun shade of FIG. 24, however, the top panel of the flexible material has been removed so that some of the internal components can be seen.

The reference numeral 470 generally depicts the entire covering of flexible material. As part of this covering, there is a top panel 472, a left panel (in this view) 474, and a rear panel (in this view) 478. Other panels are depicted in FIG. 25. Referring still to FIG. 24, there are two upper "ridges" of material at 471 which each cover a support member 450 (see FIG. 25). There is also an upper "ridge" of material 479, that extends transverse across the rear, upper portion of the sun shade assembly 400. This is a reinforcing layer that also covers a pair of torsion springs 440 (see FIG. 25).

Also viewable in FIG. 24 are two press fit chair connectors 420, and one of the retainer strings 495. There actually is a pair of retainer strings 425, and both can be seen in FIG. 25.

Referring now to FIG. 25, some of the same structural features are viewed here that were also viewed on FIG. 24, including the "left" panel of the covering 474, one of the retainer strings 495, and the two press fit chair connectors 420. In addition, a second retainer string 495 is depicted in this view. FIG. 25 also illustrates a "front" panel 475 of the covering, as well as the "right" panel (in this view) 476. These are now visible in FIG. 25 because the top panel 472 has been removed for purposes of clarity.

As can be seen in FIG. 25, the press fit chair connectors 420 extend all the way to a pair of torsion springs 440. Extending further forward (away from the viewer in this FIG. 25) is a pair of support members 450. These two support members 450 extend all the way from the torsion springs 440 to the very front of the device (which is where the front panel 475 is located). The torsion springs can be angularly displaced, which allows the angular relationship between the chair connectors 420 and the support members 450 to be varied by the human user.

FIG. 25 also depicts a cross-frame sub-assembly which comprises a first stretcher support arm 462, a second stretcher support arm 464, and a pivotable locking member 460. These components operate in a similar manner to the stretcher support arms 62 and 64 and pivotable locking member 60 that are illustrated on FIGS. 2-4, and their operations were discussed above. In this third alternative embodiment 400, the exact shapes of the stretcher support arms 462 and 464 are somewhat different than the previous embodiment for the stretcher support arms 62 and 64, and the shape is also different for the locking member 460 as compared to the earlier embodiment locking member 60. These will be discussed below in further detail.

Figure 26:
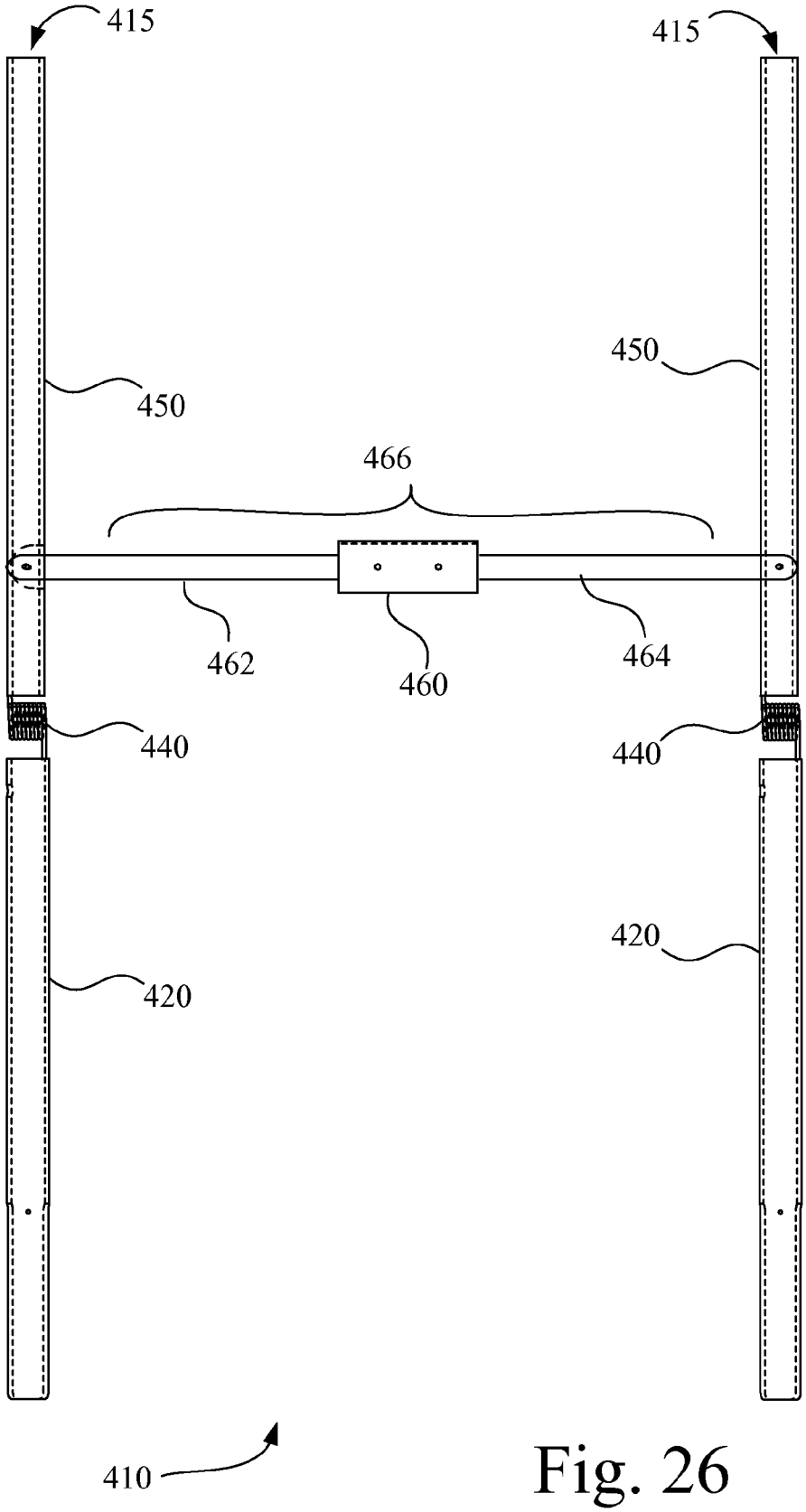
FIG. 26 is an elevational view of the framework sub-assembly of the sun shade of FIG. 24, in which the flexible support members are not bent at an angle, but instead are disposed in a substantially linear manner.
Figure 27:
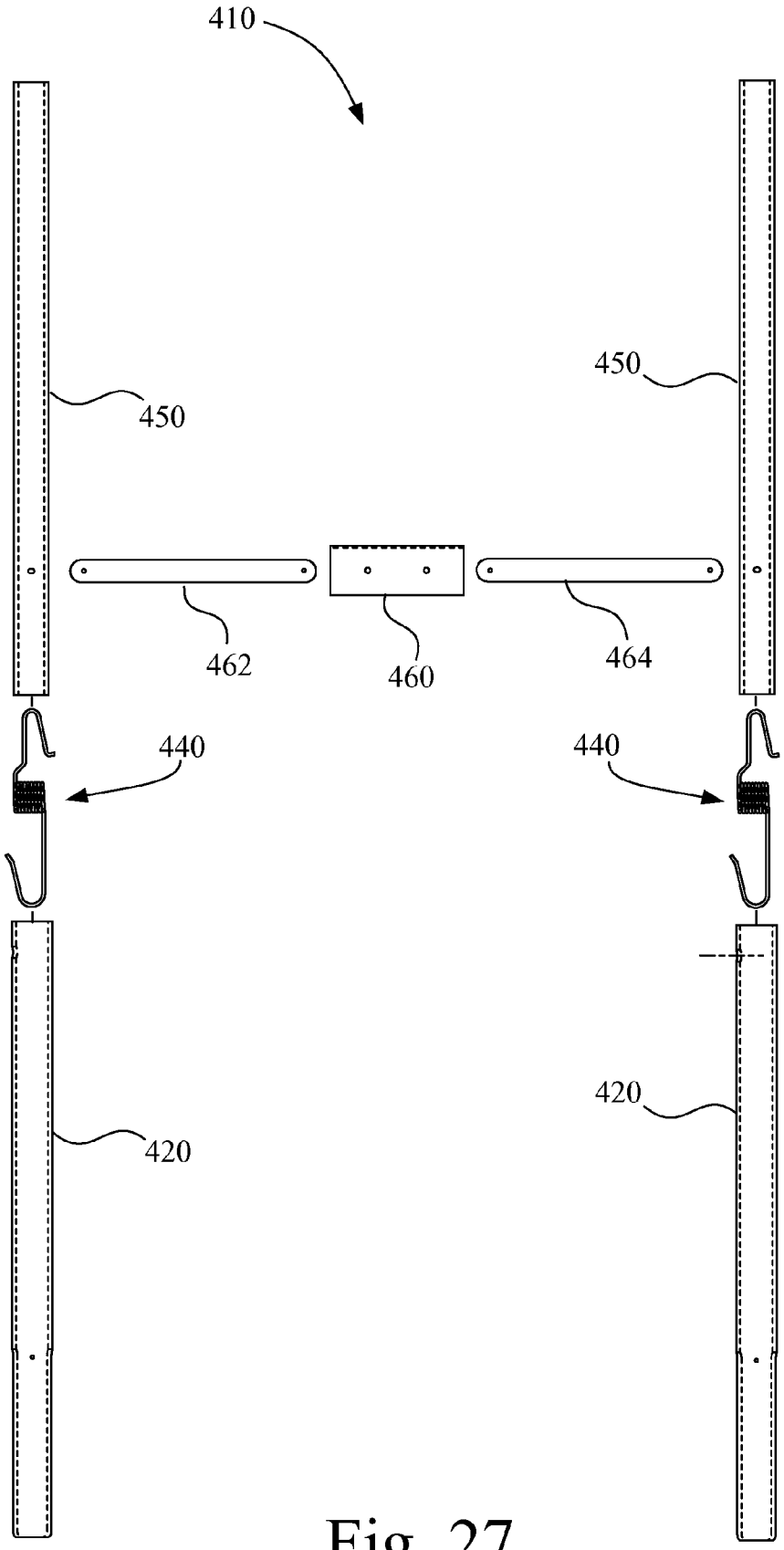
FIG. 27 is an exploded view of the major parts of the framework sub-assembly of FIG. 26.

Referring now to FIG. 26, the major components of the sun shade of the third alternative embodiment are depicted in an assembly view, and in FIG. 27 these same components are depicted in an exploded view. The two chair connectors 420 are at one end of the assembly, and these are each in turn mechanically connected to one of the torsion springs 440. The entire framework is generally designated by the reference numeral 410. The chair connectors 420 are longer than the previous chair connectors 20 that are depicted in FIGS. 2-4, and the "new" chair connectors 420 essentially encompass all of the previous components 30, 22, and 20 in one part. There also is no need for an adapter 32.

On the opposite end of the torsion springs 440 are support members 450, one per torsion spring. Each support member 450 extends all the way to the "top" (in this view) of the framework sub-assembly 410. There is no "end cap," such as the end cap 52 found in the first embodiment (see FIGS. 2-4). Support members 450 are each mechanically connected to the torsion springs 440. In this construction of the third alternative embodiment 400, each torsion spring 440 replaces an adapter 32, a flexible and bendable support member 40, and a second coupler/adapter 42. In the third alternative embodiment, there essentially are no adapters or extra couplers required anywhere in the framework 410.

There are two spaced-apart sub-assemblies 415 in the sun shade 400 of the third embodiment, in which the two sub-assemblies 415 are made up of the components that, on one end, begin with the chair connector 420 and, on the other end, finish with the support member 450. These two sub-assemblies 415 are connected by a pair of "stretcher support arms," which also have a locking member. On FIG. 26, the locking member is pivotable, and is generally designated by the reference numeral 460. A first stretcher support arm is at 462 and a second stretcher support arm is at 464. The combination of these three components 460, 462, and 464 is also referred to herein as a cross-frame sub-assembly 466. The first stretcher support arm 462 is in pivotable communication with one of the support members 450, and a second stretcher support arm 464 is in pivotable communication with the other support member 450, as seen in FIG. 26. Both stretcher support arms 462 and 464 are in pivotable mechanical communication with the pivotable locking member 460. Each of these members is shown in greater detail in later figures and discussed below.

The pivotable nature of the stretcher support arms 462 and 464 along with the pivotable locking member 460 allow the sun shade 400 to be collapsed into a smaller size for storage and/or for carrying. These elements of the cross-frame sub-assembly 466 operate in the same manner as the similar elements 60, 62, and 64, as illustrated in FIGS. 22 and 23, and as discussed above.

Figure 28A:
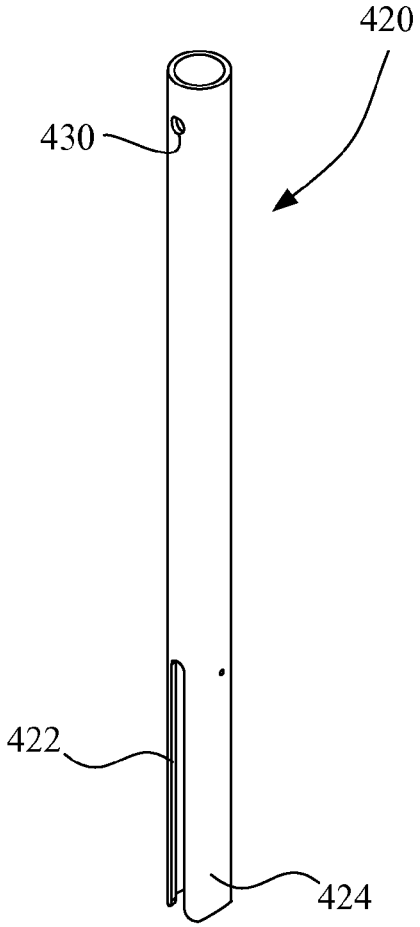
FIGS. 28A-28C are three views of a second alternative embodiment chair connector that is used in the sun shade of FIG. 24.
Figure 28B:
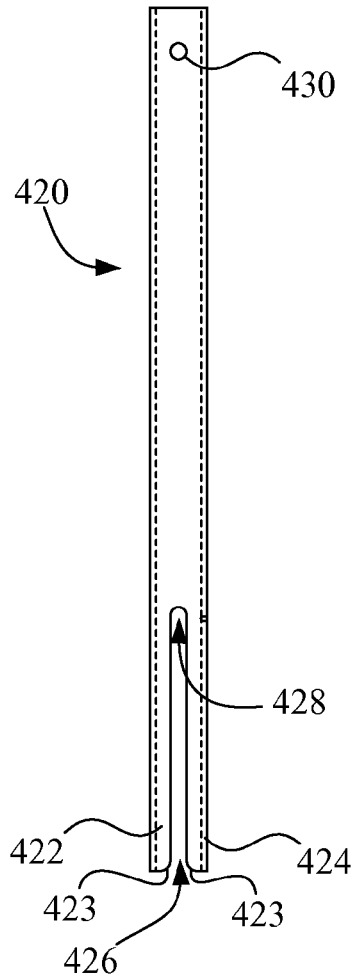
Figure 28C:
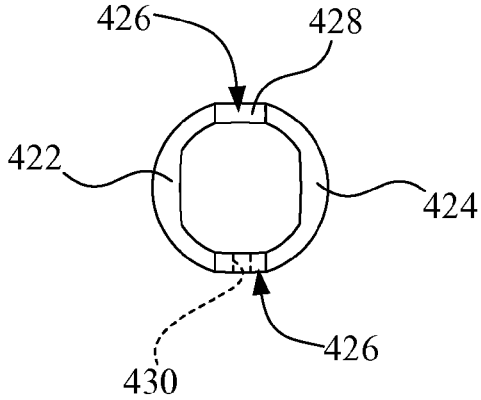

Referring now to FIGS. 28A-28C, the chair connector 420 is depicted in detail, for the third alternative embodiment. In FIGS. 28A and 28B, an open slot area 426 can be seen, and this area is used to slide the chair connector 420 over portions of a canvas chair 80, so that the chair connector 420 essentially "clips" onto the back portion of the chair 80. More specifically, the connector 420 slides over the top back frame member 82 in the upper portion of the upper right rear frame members 84 on either side of the canvas chair 80. This provides the chair connector 420 with sufficient mechanical rigidity so that the sun shade 400 will remain in place and will not collapse after the chair connector 420 has been "clipped" onto the back portion of the chair 80.

The opening or slot 426 in the side walls of the chair connector 420 preferably are large enough to fit over the frame members of many different manufacturers and models of canvas chairs. At the same time, the slot 426 should not be too large, or it would easily slip off the canvas chair framework. There is an inner radius at 428 of the opening of the slot 426, which is about 3/16 inches in the illustrated embodiment, and the outer radius of the slotted area at 423 is about ¼ inches, which are the same dimensions as in the first embodiment chair connector 20. If desired, the dimensions of the slot 426 can be the same as in the first embodiment chair connector 20, but of course, these dimensions can be varied, as per the desires of the designer for the sun shade apparatus 400.

Except for its overall length, the chair connector 420 is very similar to the first embodiment chair connector 20. Chair connector 420 has two main portions or "halves" at 422 and 424, which are separated by the slot area 426. While the chair connector 420 is made of a fairly strong and rigid material, it is not so rigid that the two halves 422 and 424 cannot be spread apart by a small distance when the sun shade 400 of the present invention is in use. This is a desirable feature, as discussed above in connection with the earlier embodiments.

Chair connector 420 also has a small opening 430 in its side wall, which can be seen on FIGS. 28A, 28B, and 28C. This small opening 430 is used to receive a "tip" portion 444 of the torsion spring 440. This arrangement holds the torsion spring 440 in position within the chair connector 420.

Figure 29:
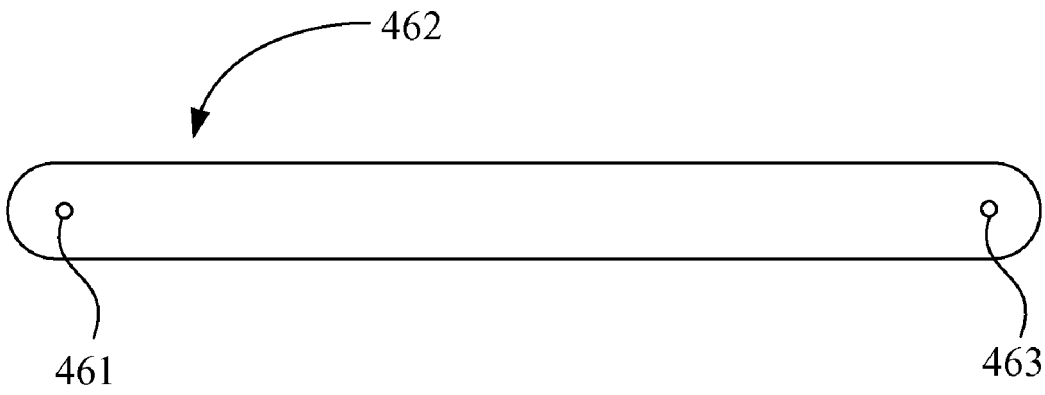
FIG. 29 is a plan view of an alternative embodiment stretcher support arm that is used in the sun shade of FIG. 24.

Referring now to FIG. 29, the "stretcher support arm" 462 is illustrated. This support arm 462 does not itself "stretch," but instead it is used to provide tension to the flexible material top panel 472, and in effect it tends to stretch that material. Stretcher support arm 462 has two rounded ends that can be symmetrical in shape, if desired. (This is different from the first embodiment stretcher support arm 62.) There are two openings 461 and 463 in stretcher support arm 462, and these openings operate with a pivoting member (e.g., a bolt) that allows the stretcher support arm 462 to pivot with respect to its mating element. It will be understood that the stretcher support arm 464 is made of a like construction.

Figure 30:
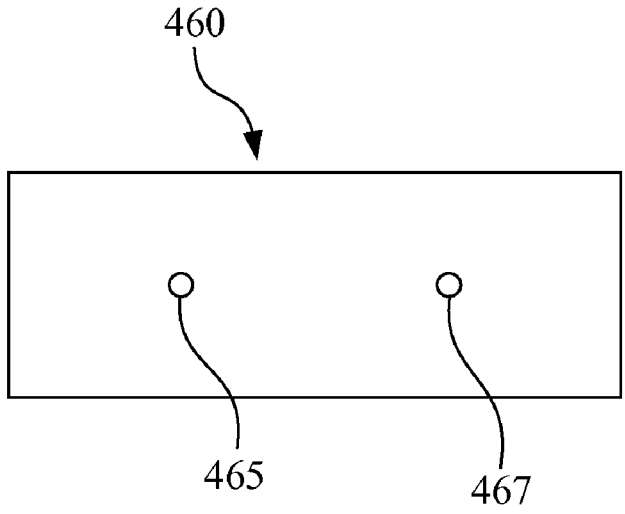
FIG. 30 is a plan view of an alternative embodiment pivotable locking member that is used in the sun shade of FIG. 24.

Referring now to FIG. 30, the pivotable locking member 460 is illustrated in greater detail. Its overall shape is now rectangular, as opposed to the five-sided polygonal shape of the locking member 60 depicted in FIG. 15C. Locking member 460 includes two openings at 465 and 467. These mate with openings in the stretcher support arms, such as the opening 463 in the stretcher support arm 462. The openings 463 and 465 will mate along a co-linear centerline, and a fastener (such as a bolt) can be placed through these two openings to hold them into pivotable mechanical communication.

Figure 31A:
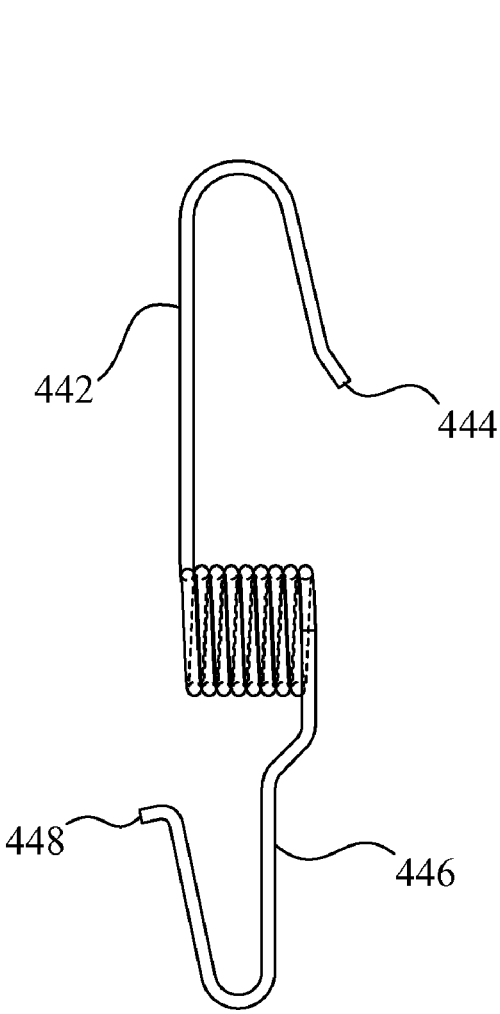
FIGS. 31A and 31B are two views of a torsion spring that is used in the sun shade of FIG. 24.
Figure 31B:
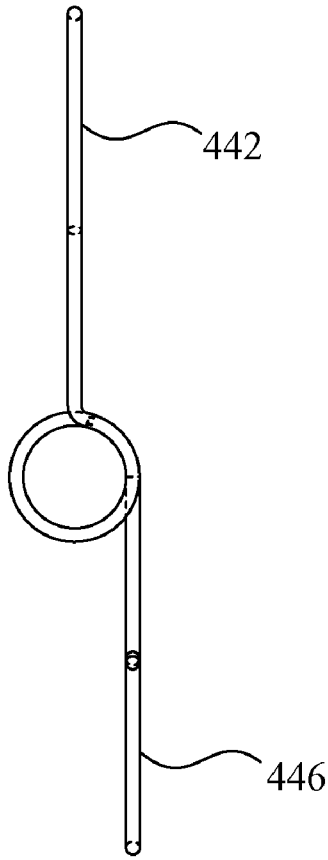

Referring now to FIGS. 31A and 31B, the torsion springs 440 are depicted. Each of these springs has two extensions, at 442 and 446. There is a "tip" 444 at the end of the spring wire extension 442 that mates with the opening 430 of the press fit chair connectors 420. There is also an angled tip at 448, which is at the end of the spring wire extension 446. The shape of the spring wire 446, with its associated tip 448, helps to hold the fairly long support members 450 in position with respect to the torsion springs 440.

Figure 32:
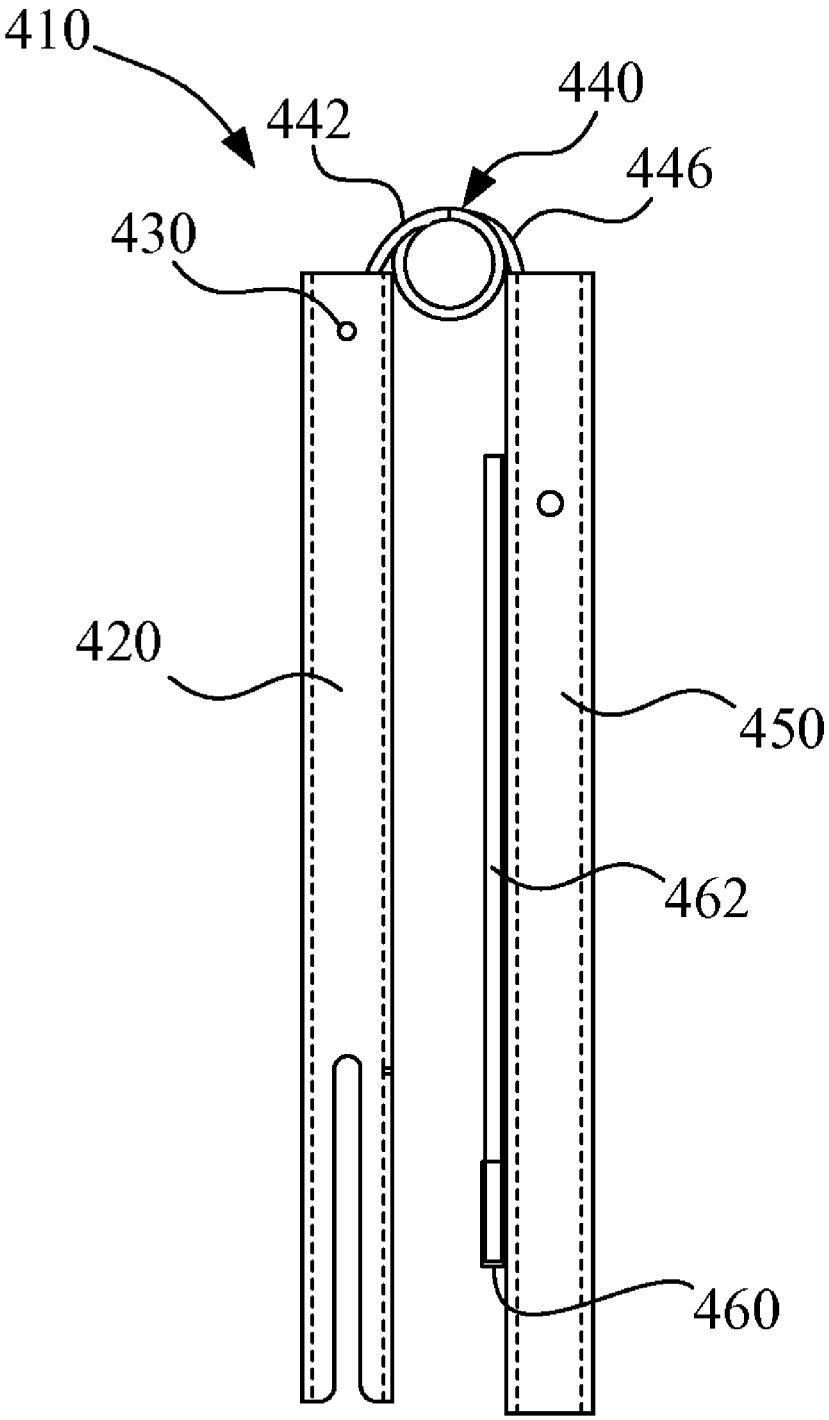
FIG. 32 is an elevational view of a compacted configuration of the sun shade of FIG. 24.

Referring now to FIG. 32, the overall size of the sun shade apparatus 400 can be made smaller by allowing it to be folded in on itself, using the torsion springs 440 as pivot points. This compacted configuration is illustrated in FIG. 32. Along the (viewed) near side, the chair connector 420 is along the left (in this view) and extends downward, while the support arm 450 is along the right (in this view) and also extends downward. The torsion spring 440 allows these two members 420 and 450 to pivot with respect to one another, thereby making the overall length of the sun shade framework 410 about one-half of its non-compacted size.

The spring wire extension 442 fits into the chair connector 420, while the spring wire extension 446 fits into the support member 450, as discussed above. In this manner, the torsion springs 440 act as a variable angle member and thus allows the angle between the (first) longitudinal axis of the support member 450 and the (second) longitudinal axis of the press fit chair connector member 420 to be varied by a human user, without the use of additional fasteners, or locking/unlocking hardware. By use of the principles of the present invention, the variable angle capability can be utilized while maintaining structural mechanical communication between each of the press fit chair connectors 420 and the corresponding torsion springs 440, and also while maintaining structural mechanical communication between each of the support members 450 and the corresponding torsion springs 440.

The stretcher support arm 462 is also in its folded (or compacted) position and has pivoted with respect to the locking members 460, as illustrated on FIG. 32.

All documents cited in the Background of the Invention and in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed, and the present invention may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A support frame apparatus for a sun shade, said support frame comprising:

(a) a first frame-half sub-assembly, comprising: a first elongated support member extending between a first end and a second end along a first longitudinal axis; a first elongated press fit chair connector member extending between a third end and a fourth end along a second longitudinal axis; a first variable angle member that is in mechanical communication with said second end of the first elongated support member and that is in mechanical communication with said third end of the first elongated press fit chair connector member;

(b) a second frame-half sub-assembly, comprising: a second elongated support member extending between a fifth end and a sixth end along a third longitudinal axis; a second elongated press fit chair connector member extending between a seventh end and an eighth end along a fourth longitudinal axis; a second variable angle member that is in mechanical communication with said sixth end of the second elongated support member and that is in mechanical communication with said seventh end of the second elongated press fit chair connector member; and (c) at least one cross-frame member that is in mechanical communication with said first elongated support member and with said second elongated support member and, in one configuration, which tends to hold said first and second elongated support members in a spaced-apart relationship;

wherein:

said first and second press fit chair connector members each are capable of being press fit to, and then maintain their positions on, an external object without the use of locking/unlocking hardware; and said first and second press fit chair connector members are spaced-apart from one another, and at their fourth and eighth ends are capable of being moved to a plurality of different positions, each having a varying distance from one another, without the use of locking/unlocking hardware.

2. The support frame apparatus of claim 1, wherein said at least one cross-frame member comprises:

(a) a first elongated support arm extending between a ninth end and a tenth end along a fifth longitudinal axis, in which said ninth end is pivotally mounted to said first elongated support member;

(b) a second elongated support arm extending between an eleventh end and a twelfth end along a sixth longitudinal axis, in which said eleventh end is pivotally mounted to said second elongated support member; and (c) a locking member that engages said tenth end of the first support arm and engages said twelfth end of the second support arm, in which both said tenth end and said twelfth end are pivotally mounted to said to said locking member;

wherein:

(d) said first and second support arms can be positioned in a first configuration such that their fifth and sixth longitudinal axes are substantially co-linear to one another, and thereby essentially lock said first and second elongated support members into a distal spaced-apart position; and (e) said first and second support arms can be pivoted from said first configuration and re-positioned into a second configuration such that their fifth and sixth longitudinal axes are substantially parallel to one another, and thereby essentially collapse said first and second elongated support members into a proximal position.

3. The support frame apparatus of claim 2, wherein:

(a) said distal spaced-apart position of the first and second elongated support members places the first and second elongated support members at a maximum distance from one another for use as a sun shade, and (b) said proximal position of the first and second elongated support members places the first and second elongated support members at a minimum distance from one another, for storage.

4. The support frame apparatus of claim 1, wherein said first and second variable angle members each comprise:

a torsion spring having a first extension wire that is in contact with one of said first and second elongated support members, and a second extension wire that is in contact with one of said first and second elongated press fit chair connector members.

5. The support frame apparatus of claim 1, wherein said first and second variable angle members each comprise:

an elongated flexible tubular member that extends between an end having a first coupler and an end having a second coupler, wherein said first coupler is in contact with one of said first and second elongated support members, and said second coupler is in contact with one of said first and second elongated press fit chair connector members.

6. The support frame apparatus of claim 1, further comprising a flexible material covering that is positioned between said first and second elongated support members to create a shade area beneath said flexible material covering.

7. The support frame apparatus of claim 6, wherein said wherein said at least one cross-frame member is deployed in a maximum length configuration that tends to stretch said flexible material covering.

8. The support frame apparatus of claim 1, wherein said first elongated press fit chair connector member exhibits a first elongated slot opening at its fourth end, and said second elongated press fit chair connector member exhibits a second elongated slot opening at its eighth end.

9. The support frame apparatus of claim 8, wherein said first and second elongated slots are sufficiently rigid to maintain a mechanical fit between an external chair and said support frame apparatus at attachment points, but also said first and second elongated slots exhibit sufficient flexibility to allow said external chair to be of different sizes at the attachment points.

10. The support frame apparatus of claim 1, further comprising:

(a) a first set of retainer strings that extend between said first elongated press fit chair connector member and said first end of the first elongated support member, and (b) a second set of retainer strings that extend between said second elongated press fit chair connector member and said fifth end of the second elongated support member.

11. A support frame apparatus for a sun shade, said support frame comprising:

(a) a first frame-half sub-assembly, comprising: a first elongated support member extending between a first end and a second end along a first longitudinal axis; a first elongated press fit chair connector member extending between a third end and a fourth end along a second longitudinal axis; a first variable angle member that is in mechanical communication with said second end of the first elongated support member and that is in mechanical communication with said third end of the first elongated press fit chair connector member;

(b) a second frame-half sub-assembly, comprising: a second elongated support member extending between a fifth end and a sixth end along a third longitudinal axis; a second elongated press fit chair connector member extending between a seventh end and an eighth end along a fourth longitudinal axis; a second variable angle member that is in mechanical communication with said sixth end of the second elongated support member and that is in mechanical communication with said seventh end of the second elongated press fit chair connector member; and (c) at least one cross-frame member that is in mechanical communication with said first elongated support member and with said second elongated support member and, in one configuration, which tends to hold said first and second elongated support members in a spaced-apart relationship;

wherein:

said first variable angle member allows a first angle between said first longitudinal axis and said second longitudinal axis to be varied by a human user, without the use of additional fasteners, while maintaining structural mechanical communication between said first elongated support member and said first variable angle member, and while maintaining structural mechanical communication between said first variable angle member and said first elongated press fit chair connector member;

said second variable angle member allows a second angle between said third longitudinal axis and said fourth longitudinal axis to be varied by a human user, without the use of additional fasteners, while maintaining structural mechanical communication between said second elongated support member and said second variable angle member, and while maintaining structural mechanical communication between said second variable angle member and said second elongated press fit chair connector member; and said first and second elongated press fit chair connector members each are capable of being affixed to an external object.

12. The support frame apparatus of claim 11, wherein:

said first and second press fit chair connector members each are capable of being press fit to, and then maintain their positions on, said external object without the use of locking/unlocking hardware; and said first and second press fit chair connector members are spaced-apart from one another, and at their fourth and eighth ends are capable of being moved to a plurality of different positions, each having a varying distance from one another, without the use of locking/unlocking hardware.

13. The support frame apparatus of claim 11, wherein said at least one cross-frame member comprises:

(a) a first elongated support arm extending between a ninth end and a tenth end along a fifth longitudinal axis, in which said ninth end is pivotally mounted to said first elongated support member;

(b) a second elongated support arm extending between an eleventh end and a twelfth end along a sixth longitudinal axis, in which said eleventh end is pivotally mounted to said second elongated support member; and (c) a locking member that engages said tenth end of the first support arm and engages said twelfth end of the second support arm, in which both said tenth end and said twelfth end are pivotally mounted to said to said locking member;

wherein:

(d) said first and second support arms can be positioned in a first configuration such that their fifth and sixth longitudinal axes are substantially co-linear to one another, and thereby essentially lock said first and second elongated support members into a distal spaced-apart position; and (e) said first and second support arms can be pivoted from said first configuration and re-positioned into a second configuration such that their fifth and sixth longitudinal axes are substantially parallel to one another, and thereby essentially collapse said first and second elongated support members into a proximal position.

14. The support frame apparatus of claim 13, wherein:

(a) said distal spaced-apart position of the first and second elongated support members places the first and second elongated support members at a maximum distance from one another for use as a sun shade, and (b) said proximal position of the first and second elongated support members places the first and second elongated support members at a minimum distance from one another, for storage.

15. The support frame apparatus of claim 11, wherein said first and second variable angle members each comprise:

a torsion spring having a first extension wire that is in contact with one of said first and second elongated support members, and a second extension wire that is in contact with one of said first and second elongated press fit chair connector members.

16. The support frame apparatus of claim 11, further comprising a flexible material covering that is positioned between said first and second elongated support members to create a shade area beneath said flexible material covering.

17. The support frame apparatus of claim 16, wherein said wherein said at least one cross-frame member is deployed in a maximum length configuration that tends to stretch said flexible material covering.

18. The support frame apparatus of claim 11, wherein said first elongated press fit chair connector member exhibits a first elongated slot opening at its fourth end, and said second elongated press fit chair connector member exhibits a second elongated slot opening at its eighth end.

19. The support frame apparatus of claim 18, wherein said first and second elongated slots are sufficiently rigid to maintain a mechanical fit between an external chair and said support frame apparatus at attachment points, but also said first and second elongated slots exhibit sufficient flexibility to allow said external chair to be of different sizes at the attachment points.

20. The support frame apparatus of claim 15, wherein said first elongated support member and said first elongated press fit chair connector member can be folded at said torsion spring, thereby placing said support frame apparatus into a compacted configuration for storage.

* * * * *